US010697352B2

(12) United States Patent
Uto et al.

(10) Patent No.: US 10,697,352 B2
(45) Date of Patent: Jun. 30, 2020

(54) VEHICLE THERMAL MANAGEMENT SYSTEM

(71) Applicant: Honda Motor Co., Ltd., Tokyo (JP)

(72) Inventors: Hajime Uto, Saitama (JP); Masanobu Takazawa, Saitama (JP); Masayuki Toyokawa, Saitama (JP); Naoaki Takeda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/424,497

(22) Filed: May 29, 2019

(65) Prior Publication Data

US 2019/0383206 A1 Dec. 19, 2019

(30) Foreign Application Priority Data

Jun. 14, 2018 (JP) ..... 2018-113374

(51) Int. Cl.
*F01P 11/20* (2006.01)

(52) U.S. Cl.
CPC ..... *F01P 11/20* (2013.01); *F01P 2011/205* (2013.01); *F01P 2037/02* (2013.01)

(58) Field of Classification Search
CPC ..... B60K 11/04; B60K 11/02; B60K 11/085; F01P 2011/205
See application file for complete search history.

(56) References Cited

U.S. PATENT DOCUMENTS

2011/0061405 A1* 3/2011 Watanabe ..... B60H 1/3227 62/61
2012/0049664 A1* 3/2012 Yokoyama ..... B60H 1/00392 310/53
2014/0290296 A1* 10/2014 Katoh ..... F28D 1/0452 62/238.7
2015/0007731 A1* 1/2015 Shinoda ..... B01D 53/0462 96/111
2015/0233627 A1* 8/2015 Ragazzi ..... B60H 1/00921 62/82
2015/0260442 A1* 9/2015 Ragazzi ..... F25D 21/08 62/80
2017/0009677 A1* 1/2017 Brinkmann ..... F02D 41/0007
2017/0021700 A1* 1/2017 Smith ..... B60H 1/3225
2017/0054188 A1* 2/2017 Blatchley ..... H01M 10/663
2017/0182860 A1* 6/2017 Miyakoshi ..... B60H 1/00

FOREIGN PATENT DOCUMENTS

JP 2015200194 11/2015

* cited by examiner

*Primary Examiner* — Long T Tran
(74) *Attorney, Agent, or Firm* — JCIPRNET

(57) ABSTRACT

A thermal management system of a vehicle includes: a cooling circuit in which cooling water circulates; a heat accumulator storing the cooling water; a flow control valve adjusting a flow rate of the cooling water flowing to the heat accumulator; a radiator; a thermostatic valve adjusting the flow rate of the cooling water flowing to the radiator; a grille shutter adjusting amount of outside air introduced from a front grille into an engine room; a cooling water temperature sensor; a heat radiation control unit supplying the cooling water to the cooling circuit to warm up an engine when the engine is cold; and a heat storage control unit, by controlling opening degrees of the flow control valve and the grille shutter according to a cooling water temperature, supplying from the cooling circuit to the heat accumulator the cooling water whose temperature is raised by heat of the engine.

20 Claims, 9 Drawing Sheets

VEHICLE THERMAL MANAGEMENT SYSTEM

CROSS-REFERENCE TO RELATED APPLICATION

This application claims the priority benefit of Japan Application No. 2018-113374, filed on Jun. 14, 2018. The entirety of the above-mentioned patent application is hereby incorporated by reference herein and made a part of this specification.

BACKGROUND

Technical Field

The disclosure relates to a thermal management system of a vehicle. More particularly, the disclosure relates to a thermal management system of a vehicle which uses waste heat of an engine after warm-up to warm up the engine when it is cold.

Related Art

In a vehicle equipped with an engine as a driving force source, in many cases, heat generated in the engine during traveling is released as waste heat to outside air by a radiator. Therefore, in recent years, there has been proposed a thermal management system in which cooling water that has become hot due to the waste heat of the engine is recovered by a heat accumulator and the cooling water stored in the heat accumulator is used for warming up the engine at the next startup. According to a vehicle equipped with such a thermal management system, since the engine can be promptly warmed up by using thermal energy conventionally released as waste heat to the outside air, fuel efficiency can be improved, and the burden on an exhaust gas purifier can further be reduced.

By the way, in such a thermal management system, it is preferable to store as much high temperature cooling water as possible in the heat accumulator. However, when the outside air has a low temperature or when a traveling distance is short, it is difficult to obtain high temperature cooling water. In addition, since the waste heat of the engine is released not only from the radiator but also from an engine surface, when traveling wind flows into an engine room and the engine is directly cooled by the traveling wind, it is difficult to secure high temperature cooling water in the heat accumulator.

To solve such problems, it is conceivable to provide a grille shutter as shown in Patent Document 1, for example, on a front grille of the vehicle so as to prevent the traveling wind from flowing into the engine room. However, conventionally, it has not been adequately studied how to specifically combine control of the grille shutter with heat storage control for storing the cooling water in the heat accumulator so that high temperature cooling water can be secured in the heat accumulator by effectively using the waste heat of the engine while warm-up or cooling of the engine is prevented from being hindered. In addition, in a system storing the cooling water in the heat accumulator in this way, since a total amount of the cooling water circulating throughout the entire system increases accordingly, warm-up of the engine becomes more likely to be hindered.

PATENT DOCUMENTS

Patent Document 1: Japanese Laid-open No. 2015-200194

SUMMARY

A thermal management system (e.g., later-described thermal management system 1) of a vehicle (e.g., later-described vehicle V) according to the disclosure includes: a cooling circuit (e.g., later-described cooling circuit 3) in which cooling water exchanging heat with an engine (e.g., later-described engine 2) circulates; a heat accumulator (e.g., later-described heat accumulator 51) connected to the cooling circuit and storing the cooling water; a first valve (e.g., later-described flow control valve 54) adjusting a flow rate of the cooling water flowing from the cooling circuit to the heat accumulator; a radiator (e.g., later-described radiator 35) connected to the cooling circuit and performing heat exchange between the cooling water and the atmosphere; a second valve (e.g., later-described thermostatic valve 33) adjusting the flow rate of the cooling water flowing from the cooling circuit to the radiator; a shutter (e.g., later-described grille shutter 6) adjusting amount of outside air introduced from a front grille (e.g., later-described front grille G) into an engine room (e.g., later-described engine room R); a cooling water temperature acquisition means (e.g., later-described cooling water temperature sensor 36) acquiring a cooling water temperature of the cooling circuit; a heat radiation control means (e.g., later-described heat radiation control unit 71) supplying the cooling water from the heat accumulator to the cooling circuit to warm up the engine when the engine is cold; and a heat storage control means (e.g., later-described heat storage control unit 72) executing heat storage control in which, by controlling an opening degree of the first valve and an opening degree of the shutter according to the cooling water temperature, the cooling water whose temperature is raised by heat of the engine is supplied from the cooling circuit to the heat accumulator.

A thermal management system (e.g., later-described thermal management system 1A) of a vehicle (e.g., later-described vehicle VA) according to the disclosure includes: a cooling circuit (e.g., later-described cooling circuit 3) in which cooling water exchanging heat with an engine (e.g., later-described engine 2) circulates; a heat accumulator (e.g., later-described heat accumulator 51) connected to the cooling circuit and storing the cooling water; a first valve (e.g., later-described flow control valve 54) adjusting a flow rate of the cooling water flowing from the cooling circuit to the heat accumulator; a radiator (e.g., later-described radiator 35) connected to the cooling circuit and performing heat exchange between the cooling water and the atmosphere; a second valve (e.g., later-described thermostatic valve 33) adjusting the flow rate of the cooling water flowing from the cooling circuit to the radiator; an insulating container (e.g., later-described heat storage capsule 8) accommodating at least the engine; a shutter (e.g., later-described outside air shutter 9) adjusting amount of outside air introduced into the insulating container from an outside air inlet (e.g., later-described outside air inlet 81) formed in the insulating container; a cooling water temperature acquisition means (e.g., later-described cooling water temperature sensor 36) acquiring a cooling water temperature of the cooling circuit; a heat radiation control means (e.g., later-described heat radiation control unit 71A) supplying the cooling water from the heat accumulator to the cooling circuit to warm up the engine when the engine is cold; and a heat storage control means (e.g., later-described heat storage control unit 72A)

executing heat storage control in which, by controlling an opening degree of the first valve and an opening degree of the shutter according to the cooling water temperature, the cooling water whose temperature is raised by heat of the engine is supplied from the cooling circuit to the heat accumulator.

DESCRIPTION OF THE EMBODIMENTS

Figure 1:
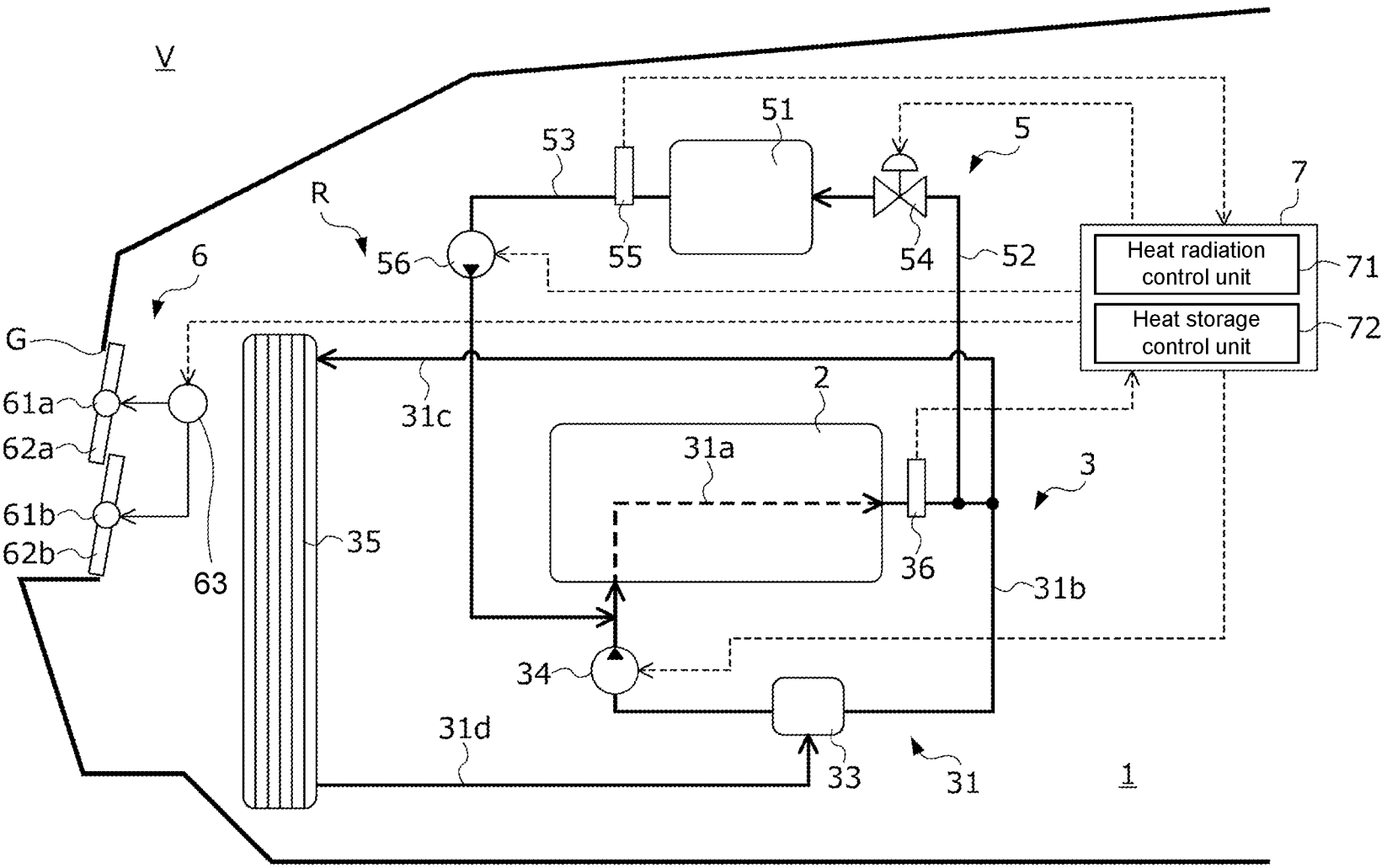
FIG. 1 illustrates a configuration of a thermal management system and a vehicle equipped with this thermal management system according to a first embodiment of the disclosure.

The disclosure provides a thermal management system of a vehicle, capable of securing high temperature cooling water in a heat accumulator while preventing warm-up or cooling of an engine from being hindered.

(1) A thermal management system (e.g., later-described thermal management system 1) of a vehicle (e.g., later-described vehicle V) according to the disclosure includes: a cooling circuit (e.g., later-described cooling circuit 3) in which cooling water exchanging heat with an engine (e.g., later-described engine 2) circulates; a heat accumulator (e.g., later-described heat accumulator 51) connected to the cooling circuit and storing the cooling water; a first valve (e.g., later-described flow control valve 54) adjusting a flow rate of the cooling water flowing from the cooling circuit to the heat accumulator; a radiator (e.g., later-described radiator 35) connected to the cooling circuit and performing heat exchange between the cooling water and the atmosphere; a second valve (e.g., later-described thermostatic valve 33) adjusting the flow rate of the cooling water flowing from the cooling circuit to the radiator; a shutter (e.g., later-described grille shutter 6) adjusting amount of outside air introduced from a front grille (e.g., later-described front grille G) into an engine room (e.g., later-described engine room R); a cooling water temperature acquisition means (e.g., later-described cooling water temperature sensor 36) acquiring a cooling water temperature of the cooling circuit; a heat radiation control means (e.g., later-described heat radiation control unit 71) supplying the cooling water from the heat accumulator to the cooling circuit to warm up the engine when the engine is cold; and a heat storage control means (e.g., later-described heat storage control unit 72) executing heat storage control in which, by controlling an opening degree of the first valve and an opening degree of the shutter according to the cooling water temperature, the cooling water whose temperature is raised by heat of the engine is supplied from the cooling circuit to the heat accumulator.

(2) A thermal management system (e.g., later-described thermal management system 1A) of a vehicle (e.g., later-described vehicle VA) according to the disclosure includes: a cooling circuit (e.g., later-described cooling circuit 3) in which cooling water exchanging heat with an engine (e.g., later-described engine 2) circulates; a heat accumulator (e.g., later-described heat accumulator 51) connected to the cooling circuit and storing the cooling water; a first valve (e.g., later-described flow control valve 54) adjusting a flow rate of the cooling water flowing from the cooling circuit to the heat accumulator; a radiator (e.g., later-described radiator 35) connected to the cooling circuit and performing heat exchange between the cooling water and the atmosphere; a second valve (e.g., later-described thermostatic valve 33) adjusting the flow rate of the cooling water flowing from the cooling circuit to the radiator; an insulating container (e.g., later-described heat storage capsule 8) accommodating at least the engine; a shutter (e.g., later-described outside air shutter 9) adjusting amount of outside air introduced into the insulating container from an outside air inlet (e.g., later-described outside air inlet 81) formed in the insulating container; a cooling water temperature acquisition means (e.g., later-described cooling water temperature sensor 36) acquiring a cooling water temperature of the cooling circuit; a heat radiation control means (e.g., later-described heat radiation control unit 71A) supplying the cooling water from the heat accumulator to the cooling circuit to warm up the engine when the engine is cold; and a heat storage control means (e.g., later-described heat storage control unit 72A) executing heat storage control in which, by controlling an opening degree of the first valve and an opening degree of the shutter according to the cooling water temperature, the cooling water whose temperature is raised by heat of the engine is supplied from the cooling circuit to the heat accumulator.

(3) In this case, preferably, during execution of the heat storage control, the heat storage control means controls the shutter to be in a closed state when the cooling water temperature is lower than a valve opening temperature (e.g., later-described valve opening temperature Tth1) of the second valve, and controls the shutter to be in an opened state after the cooling water temperature becomes higher than the valve opening temperature.

(4) In this case, preferably, the thermal management system further includes a heat accumulator water temperature acquisition means (e.g., later-described heat accumulator water temperature sensor 55) acquiring a heat accumulator outlet water temperature being a temperature of the cooling water flowing out from the heat accumulator, wherein the heat storage control means, after starting the heat storage control on condition that the cooling water temperature is equal to or higher than the valve opening temperature of the second valve, terminates the heat storage control according to the fact that the heat accumulator outlet water temperature (Twes) exceeds an end temperature (Tend) determined according to the cooling water temperature, wherein the end temperature (Tend) is determined lower than the cooling water temperature (Tw) by a predetermined temperature, wherein the predetermined temperature is predetermined by considering influence of a temperature drop due to heat radiation of the cooling water flowing through a passage connecting the cooling circuit with the heat accumulator.

(5) In this case, preferably, the heat storage control means sets a target opening degree of the first valve toward a closing side as a temperature difference (ΔT) obtained by subtracting the heat accumulator outlet water temperature (Twes) from the cooling water temperature (Tw) increases, and controls the opening degree of the first valve to be the target opening degree.

(6) In this case, preferably, when the cooling water temperature is in the process of rising, the heat storage control means executes the heat storage control, and when the cooling water temperature is in the process of falling, the heat storage control means does not execute the heat storage control.

(7) In this case, preferably, the shutter is controlled to be in the opened state when the cooling water temperature (Tw) is higher than a predetermined shutter opening temperature (Tsh1, Tsh3), and the heat storage control means raises the shutter opening temperature in a case where the heat storage control is being executed as compared with a case where the heat storage control is not being executed.

(8) In this case, preferably, the heat storage control means stores, as an end time water temperature (Twes_m), the temperature of the cooling water inside the heat accumulator or flowing out from the heat accumulator at termination of the heat storage control, and, if the cooling water temperature (Tw) becomes higher than the end time water temperature (Twes_m) after termination of the heat storage control, executes the heat storage control again.

(1) In the thermal management system of the disclosure, the heat accumulator storing the cooling water and the radiator are connected to the cooling circuit of the engine, the flow rate of the cooling water flowing from the cooling circuit to the heat accumulator is adjusted by the first valve, and the flow rate of the cooling water flowing from the cooling circuit to the radiator is adjusted by the second valve. In addition, the amount of the outside air introduced from the front grille into the engine room is adjusted by the shutter. In such a thermal management system, since the amount of the outside air introduced from the front grille into the engine room is limited when the shutter is closed, the amount of heat radiated from the engine to the outside air is reduced, and the temperature of the cooling water flowing through the cooling circuit rises. However, when the shutter is continuously closed, the temperature of the cooling water may excessively rise, and there is a fear that cooling of the engine may be hindered. In addition, when the first valve is opened, the cooling water whose temperature is raised by waste heat of the engine is supplied from the cooling circuit to the heat accumulator. However, when the cooling circuit and the heat accumulator are connected in this way, since the amount of the cooling water in the entire system increases as much as the capacity of the heat accumulator, warm-up of the engine is delayed accordingly. In addition, when the cooling water is supplied from the cooling circuit to the heat accumulator, since low temperature cooling water stored in the heat accumulator is pushed out to the cooling circuit, the temperature of the cooling water flowing through the cooling circuit may drop, and there is a fear that the temperature of the engine may excessively drop.

Therefore, by controlling the opening degree of the first valve and the opening degree of the shutter according to the cooling water temperature acquired by the cooling water temperature acquisition means, the heat storage control means executes the heat storage control for supplying the cooling water from the cooling circuit to the heat accumulator. Thus, according to the disclosure, high temperature cooling water can be stored in the heat accumulator while warm-up and cooling of the engine are prevented from being hindered. In addition, when the engine is cold, the heat radiation control means supplies the high temperature cooling water stored in the heat accumulator to the cooling circuit as described above, and warms up the engine through heat exchange with the high temperature cooling water. Accordingly, fuel efficiency of the vehicle can be improved and the burden on an exhaust gas purifier can further be reduced.

(2) In the thermal management system of the disclosure, at least the engine is accommodated in the insulating container. Accordingly, since heat radiation from the engine to the outside air can be reduced, the temperature of the cooling water flowing through the cooling circuit can be promptly raised, and high temperature cooling water can be secured in the heat accumulator in an early stage. In the thermal management system of the disclosure, the amount of the outside air introduced into the insulating container from the outside air inlet formed in the insulating container is adjusted by the shutter. Accordingly, according to the thermal management system of the disclosure, the same effects as those in the disclosure of the above (1) are achieved.

(3) When the cooling water temperature is lower than the valve opening temperature of the second valve, i.e., before cooling of the cooling water by the radiator is started, the heat storage control means controls the shutter to be in the closed state. Accordingly, since heat radiation from the engine to the outside air in a warm-up process can be suppressed, the temperature of the cooling water flowing through the cooling circuit can be promptly raised, and the high temperature cooling water can be secured in the heat accumulator in an early stage.

(4) The heat storage control means starts the heat storage control on condition that the cooling water temperature is equal to or higher than the valve opening temperature of the second valve, and after that, terminates the heat storage control according to the fact that the heat accumulator outlet water temperature exceeds the end temperature determined lower than the cooling water temperature by the predetermined temperature. Accordingly, the cooling water whose temperature is raised in a process of closing the second valve and warming up the engine can be stored in the heat accumulator. In addition, when the heat storage control is executed in this way, since the cooling water whose temperature is raised by the waste heat of the engine is supplied from the cooling circuit to the heat accumulator, the temperature of the cooling water stored in the heat accumulator rises and the heat accumulator outlet water temperature rises. However, in the process during which the cooling water flows from the cooling circuit to the heat accumulator, the temperature of the cooling water drops due to heat radiation. Hence, it is conceivable that the heat accumulator outlet water temperature reaches a temperature slightly lower than the cooling water temperature. Therefore, after starting the heat storage control, in the case where the heat accumulator outlet water temperature becomes equal to or higher than the end temperature determined lower than the cooling water temperature by the predetermined temperature, the heat storage control means terminates the heat storage control. Accordingly, while the cooling water heated by the engine is secured in the heat accumulator, the heat storage control can be terminated at an appropriate timing.

(5) When the heat storage control is executed in a state in which the heat accumulator outlet water temperature is excessively lower than the cooling water temperature, the high temperature cooling water from the cooling circuit flows into the heat accumulator, and the low temperature cooling water pushed out from the heat accumulator flows into the cooling circuit. Hence, the temperature of the cooling water flowing through the cooling circuit drops, the temperature of the engine drops, and there is a fear that fuel efficiency may deteriorate or the burden on the exhaust gas purifier may increase. Therefore, the heat storage control means sets the target opening degree of the first valve toward the closing side as the temperature difference obtained by subtracting the heat accumulator outlet water temperature from the cooling water temperature increases, so as to make it difficult for the cooling water to flow from the heat accumulator to the cooling circuit. Thus, according to the disclosure, by executing the heat storage control, the opening degree of the first valve can be adjusted so as to prevent an excessive drop in the temperatures of the cooling water flowing through the cooling circuit and the engine exchanging heat with the cooling water, and high temperature cooling water can be secured in the heat accumulator while deterioration in fuel efficiency or increase in burden on the exhaust gas purifier is prevented.

(6) The heat storage control means executes the heat storage control when the cooling water temperature is in the process of rising, and supplies the cooling water from the cooling circuit to the heat accumulator. In addition, the heat storage control means does not execute the heat storage control when the cooling water temperature is in the process of falling, so that the cooling water is not supplied from the cooling circuit to the heat accumulator. Accordingly, according to the disclosure, since the cooling water can be supplied to the heat accumulator in the middle of a temperature rise, the cooling water having a temperature as high as possible can be secured in the heat accumulator.

(7) The heat storage control means raises the shutter opening temperature in a case where the heat storage control is being executed as compared with a case where the heat storage control is not being executed. Accordingly, during execution of the heat storage control intended to secure the cooling water having a temperature as high as possible in the heat accumulator, by raising the shutter opening temperature, heat radiation of the engine can be suppressed, and the cooling water temperature can be more easily raised. In addition, if the heat storage control is not being executed and there is no need to secure high temperature cooling water in the heat accumulator, by lowering the shutter opening temperature, heat radiation of the engine can be promoted, so that cooling of the cooling water by the radiator and cooling of the engine can be prevented from being hindered.

(8) The heat storage control means stores, as the end time water temperature, the temperature of the cooling water inside the heat accumulator or flowing out from the heat accumulator at termination of the heat storage control, and, if the cooling water temperature becomes higher than the end time water temperature after termination of the heat storage control, executes the heat storage control again. The temperature of the cooling water flowing through the cooling circuit may rise or drop depending on an operating state of the engine or the like. With respect to this, according to the disclosure, since the temperature of the cooling water stored in the heat accumulator can accumulate according to the operating state of the engine, the cooling water having a highest temperature in a use state of the engine at that time can be secured in the heat accumulator.

First Embodiment

Hereinafter, a first embodiment of the disclosure is explained with reference to the drawings.

FIG. 1 illustrates a configuration of a thermal management system 1 and a vehicle V equipped with the thermal management system 1 according to the present embodiment.

The thermal management system 1 is mounted on the vehicle V including at least an internal combustion engine (hereinafter referred to as "engine") 2 as a driving force source. As shown in FIG. 1, the thermal management system 1 is provided in an engine room R on a front side of the vehicle V together with the engine 2. The thermal management system 1 uses waste heat generated in the engine 2 to warm up the engine 2 at the next startup.

The thermal management system 1 includes: a cooling circuit 3 including the engine 2 in a part of its path, in which cooling water circulates; a heat storage system 5 connected to the cooling circuit 3; a grille shutter 6 provided on a front grille G being an opening introducing traveling wind into the engine room R; and an electronic control unit 7 (hereinafter abbreviated as "ECU 7") controlling the cooling circuit 3, the heat storage system 5 and the grille shutter 6.

The cooling circuit 3 includes: a cooling water circulation passage 31 through which the cooling water exchanging heat with the engine 2 and its exhaust circulates; a thermostatic valve 33 as a second valve provided in the cooling water circulation passage 31; a water pump 34; a radiator 35; and a cooling water temperature sensor 36.

The cooling water circulation passage 31 includes a first cooling water passage 31*a*, a second cooling water passage 31*b*, a third cooling water passage 31*c*, and a fourth cooling water passage 31*d*. The first cooling water passage 31*a* is a cooling water passage formed in a cylinder block of the engine 2 and promotes heat exchange between the cooling water and the engine 2. The second cooling water passage 31*b* is a cooling water passage connecting an outlet of the first cooling water passage 31*a* with an inlet of the first cooling water passage 31*a*.

In the second cooling water passage 31*b*, the cooling water temperature sensor 36, the thermostatic valve 33 and the water pump 34 are provided in order from the outlet side to the inlet side of the first cooling water passage 31*a*.

The third cooling water passage 31*c* is a cooling water passage connecting the outlet of the first cooling water passage 31*a* with an inlet of the radiator 35. The fourth cooling water passage 31*d* is a cooling water passage connecting an outlet of the radiator 35 with the water pump 34 provided in the second cooling water passage 31*b*.

The radiator 35 is provided in the vicinity of the front grille G in the engine room R. The cooling water flowing in from the third cooling water passage 31*c* is cooled by heat exchange with the atmosphere being the traveling wind introduced from the front grille G in the process of flowing through a cooling water passage formed in the radiator 35, and flows out to the fourth cooling water passage 31*d*.

The cooling water temperature sensor 36 transmits to the ECU 7 a detection signal corresponding to a cooling water temperature being a temperature of the cooling water flowing out from the outlet of the first cooling water passage 31*a*.

The water pump 34 operates according to a command signal transmitted from the ECU 7 and pumps the cooling water in the second cooling water passage 31*b* from the side of the thermostatic valve 33 to the side of the engine 2. A flow of the cooling water in the cooling water circulation passage 31 is formed by the water pump 34. During a period from when the engine 2 is started until when the engine 2 is stopped again, the ECU 7 basically continuously drives the water pump 34 at all times, and circulates the cooling water in the cooling water circulation passage 31.

The thermostatic valve 33 is a valve adjusting a flow rate of the cooling water flowing from the cooling water circulation passage 31 to the radiator 35. The thermostatic valve 33 adjusts the flow rate of the cooling water flowing from the cooling water circulation passage 31 to the radiator 35 by opening and closing a cooling water passage connecting the fourth cooling water passage 31*d* with the second cooling water passage 31*b*.

If the temperature of the cooling water flowing through the second cooling water passage 31*b* is equal to or lower than a predetermined valve opening temperature Tth1 (specifically, e.g., Tth1=80° C.), the thermostatic valve 33 is maintained in a fully closed state. When the thermostatic valve 33 is in the fully closed state, the flow of the cooling water from the fourth cooling water passage 31*d* to the second cooling water passage 31*b* is blocked. That is, the flow rate of the cooling water flowing from the third cooling water passage 31*c* to the radiator 35 becomes zero. Accordingly, when the thermostatic valve 33 is in the fully closed state, the cooling water circulates in a circulation passage formed by the first cooling water passage 31*a* and the second cooling water passage 31*b*.

When the temperature of the cooling water flowing through the second cooling water passage 31*b* exceeds the valve opening temperature Tth1, the thermostatic valve 33 starts to open from the fully closed state. When the thermostatic valve 33 opens, a cooling water circulation passage is formed by the first cooling water passage 31*a*, the third cooling water passage 31*c*, the radiator 35, the fourth cooling water passage 31*d*, and the second cooling water passage 31*b*. Accordingly, when the thermostatic valve 33 starts to open, the cooling water starts to flow from the third cooling water passage 31*c* to the radiator 35. An opening degree of the thermostatic valve 33 increases as the temperature of the cooling water flowing through the second cooling water passage 31*b* increases. Hence, the flow rate of the cooling water flowing from the third cooling water passage 31*c* to the radiator 35 increases as the temperature of the cooling water increases.

When the temperature of the cooling water flowing through the second cooling water passage 31*b* exceeds a full-open temperature Tth2 (specifically, e.g., Tth2=90° C.) being higher than the valve opening temperature Tth1, the thermostatic valve 33 changes to a fully opened state. Hence, the flow rate of the cooling water flowing from the third cooling water passage 31*c* to the radiator 35 becomes maximum when the thermostatic valve 33 changes to the fully opened state.

The grille shutter 6 includes: a plurality of rotation shafts 61*a* and 61*b* provided on the front grille G; a plurality of platelike shutter members 62*a* and 62*b* provided rotatably about the rotation shafts 61*a* and 61*b*; and an electric actuator 63 rotating the shutter members 62*a* and 62*b* about the rotation shafts 61*a* and 61*b* according to a command signal transmitted from the ECU 7.

When opening degrees of the shutter members 62*a* and 62*b* are set to a predetermined full-close opening degree by the electric actuator 63, as shown in FIG. 1, the shutter members 62*a* and 62*b* become substantially parallel to an opening plane of the front grille G. Accordingly, the amount of the traveling wind introduced from the front grille G into the engine room R becomes minimum. When the opening degrees of the shutter members 62*a* and 62*b* are set to a predetermined full-open opening degree by the electric actuator 63, the shutter members 62*a* and 62*b* become substantially perpendicular to the opening plane of the front grille G. Accordingly, the amount of the traveling wind introduced from the front grille G into the engine room R becomes maximum. Accordingly, under the control of the ECU 7, the amount of the traveling wind introduced from the front grille G into the engine room R can be adjusted by controlling the opening degrees of the shutter members 62*a* and 62*b* between the full-close opening degree and the full-open opening degree.

The heat storage system 5 includes: a heat accumulator 51 being a container storing the cooling water; an introduction passage 52 and a discharge passage 53 connecting the heat accumulator 51 with the cooling circuit 3; a flow control valve 54 provided in the passage 52 and the passage 53; a heat accumulator water temperature sensor 55; and an electric pump 56.

Figure 2:
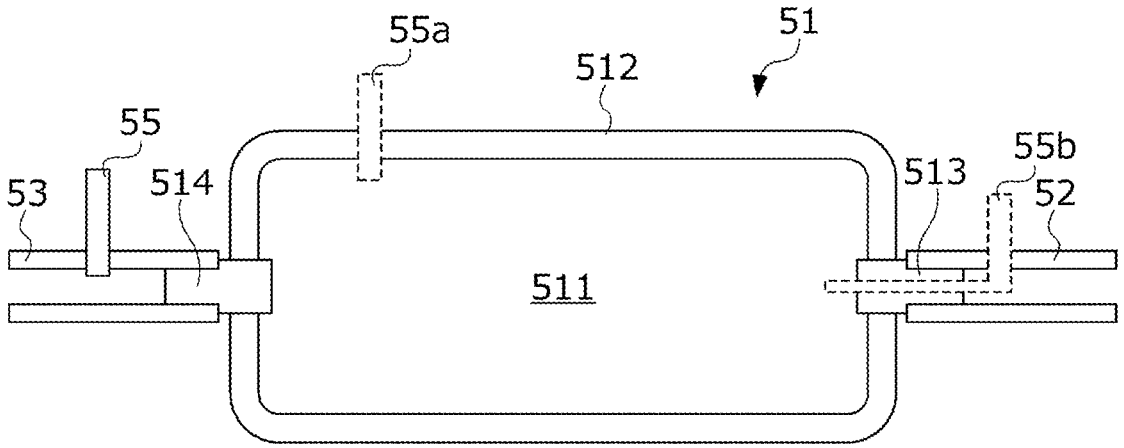
FIG. 2 schematically illustrates a configuration of a heat accumulator.

FIG. 2 schematically illustrates a configuration of the heat accumulator 51. The heat accumulator 51 is a cooling water container having a heat retention function and includes: a reservoir 511 storing the cooling water; a heat insulating layer 512 covering the reservoir 511; an introduction mouthpiece part 513 connecting the reservoir 511 with the introduction passage 52; and a discharge mouthpiece part 514 connecting the reservoir 511 with the discharge passage 53. The heat insulating layer 512, for example, has a dual structure, wherein space between an inner layer storing the cooling water and an outer layer contacting the outside air is a vacuum. In addition to such a dual structure, the heat insulating layer 512 may be made of a heat insulating material. By later-described heat storage control executed by the ECU 7, the heat accumulator 51 is filled with the cooling water heated using the waste heat of the engine 2. Also, the high temperature cooling water filled in this way by the heat storage control is used for warming up the engine 2 at the next startup by later-described heat radiation control executed by the ECU 7.

Referring back to FIG. 1, the introduction passage 52 is a cooling water passage connecting a portion of the second cooling water passage 31*b* between the cooling water temperature sensor 36 and the thermostatic valve 33 with an inlet of the heat accumulator 51. A part of the cooling water flowing through the second cooling water passage 31*b* is stored in the heat accumulator 51 via the introduction passage 52. The discharge passage 53 is a cooling water passage connecting an outlet of the heat accumulator 51 with a portion of the second cooling water passage 31*b* between the thermostatic valve 33 and the engine 2. When the cooling water is supplied to the heat accumulator 51 via the introduction passage 52, a part of the cooling water stored in the heat accumulator 51 is discharged to the second cooling water passage 31*b* via the discharge passage 53.

The flow control valve 54 is a valve adjusting the flow rate of the cooling water flowing from the second cooling water passage 31*b* to the heat accumulator 51 and is provided in the introduction passage 52. An opening degree of the flow control valve 54 is controlled by the ECU 7. When the flow control valve 54 is opened while the later-described electric pump 56 is driven, a part of the cooling water flowing through the second cooling water passage 31*b* is supplied to the heat accumulator 51 via the introduction passage 52.

The electric pump 56 is provided in the discharge passage 53. The electric pump 56 operates according to a command signal transmitted from the ECU 7 and pumps the cooling water in the discharge passage 53 from the side of the heat accumulator 51 to the side of the second cooling water passage 31*b* of the cooling circuit 3. A flow of the cooling water in the introduction passage 52, the heat accumulator 51 and the discharge passage 53 is formed by the electric pump 56. The ECU 7 supplies the cooling water in the cooling circuit 3 to the heat accumulator 51, and drives the electric pump 56 when discharging the cooling water in the heat accumulator 51 to the cooling circuit 3.

The heat accumulator water temperature sensor 55 is provided in the discharge passage 53. The heat accumulator water temperature sensor 55 detects a heat accumulator outlet water temperature being the temperature of the cooling water flowing out from the heat accumulator 51 to the discharge passage 53, and transmits a signal corresponding to the detected value to the ECU 7.

Here, a preferable detection position of the heat accumulator water temperature sensor 55 is explained with reference to FIG. 2. In the case of detecting the temperature of the cooling water stored in the heat accumulator 51 with a water temperature sensor, it is conceivable to provide the water temperature sensor at a position as indicated by reference numeral 55*a* in FIG. 2. However, when it is attempted to directly detect the temperature of the cooling water in the reservoir 511 with the water temperature sensor in this way, since it is necessary to provide the water temperature sensor so as to pass through the heat insulating layer 512, a heat insulating layer cannot be formed in this portion, and there is a fear that the heat retention function of the heat accumulator 51 may deteriorate. Also, as indicated by reference numeral 55*b* in FIG. 2, it is conceivable to directly detect the temperature of the cooling water in the reservoir 511 without passing through the heat insulating layer 512 by connecting the water temperature sensor via the introduction mouthpiece part 513. However, when the water temperature sensor is provided at such a position, heat of the cooling water in the reservoir 511 is radiated to the outside through the water temperature sensor, and there is a fear that the heat retention function of the heat accumulator 51 may deteriorate. Therefore, in the present embodiment, by providing the heat accumulator water temperature sensor 55 in the discharge passage 53, the heat retention function of the heat accumulator 51 is prevented from deteriorating.

The ECU 7 is a computer comprehensively controlling the cooling circuit 3, the heat storage system 5 and the grille shutter 6, and is composed of a heat radiation control unit 71 relating to execution of the heat radiation control using the heat accumulator 51 and a heat storage control unit 72 relating to execution of the heat storage control.

The heat radiation control unit 71 executes the heat radiation control for warming up the engine 2 by supplying cooling water from the heat accumulator 51 to the cooling circuit 3 when the engine 2 is cold. For example, if the cooling water temperature is equal to or lower than a predetermined temperature at startup of the engine 2, the heat radiation control unit 71 warms up the engine 2 using the cooling water that is stored in the heat accumulator 51 by executing the heat storage control during the previous operation of the engine 2.

Figure 3:
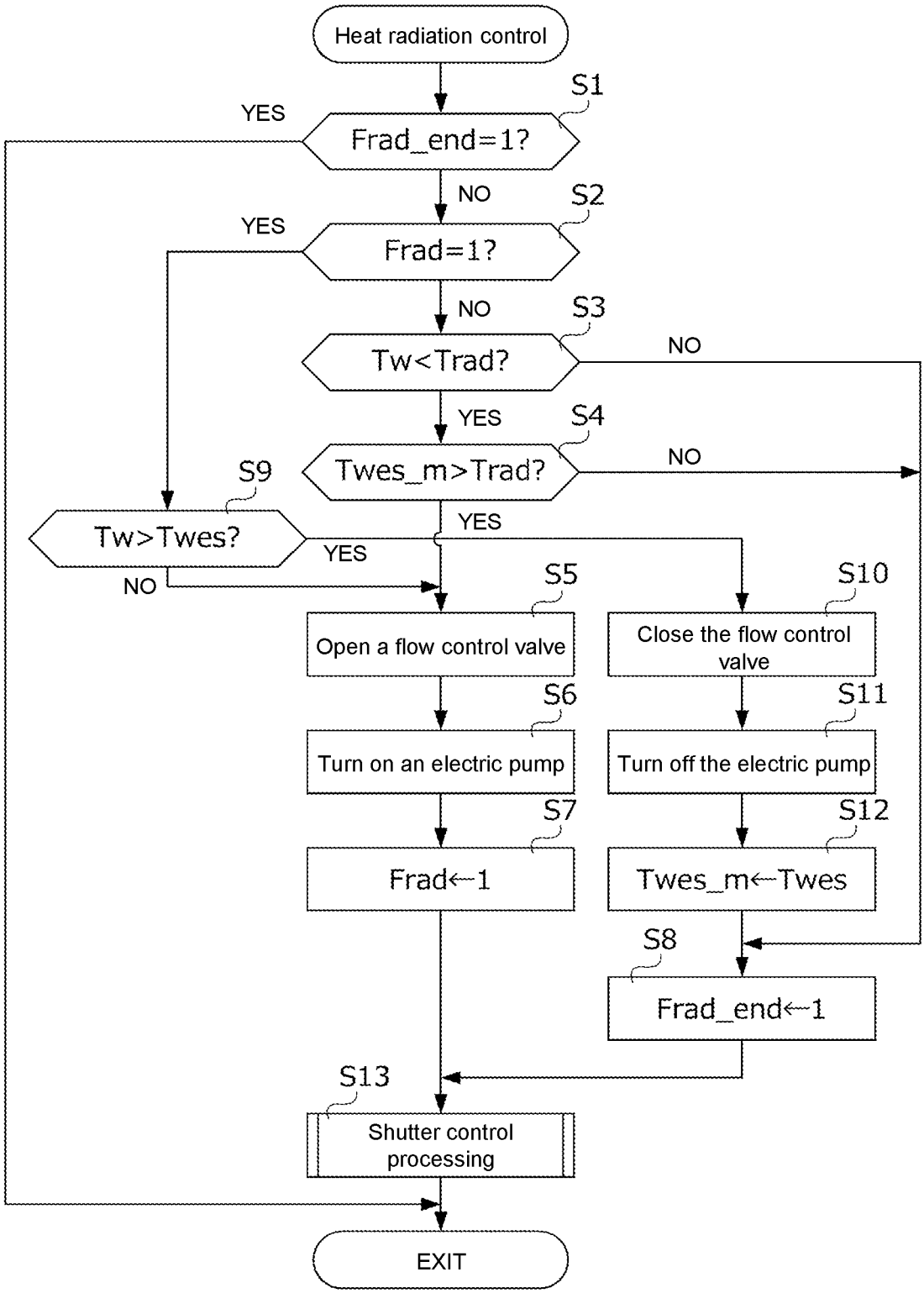
FIG. 3 is a flowchart showing a specific procedure of heat radiation control.

FIG. 3 is a flowchart showing a specific procedure of heat radiation control processing performed by the heat radiation control unit 71. During a period from when the engine 2 is started to when the engine 2 is stopped, i.e., while the engine 2 is operating, the heat radiation control processing of FIG. 3 is repeatedly executed by the heat radiation control unit 71 in a predetermined control cycle.

Firstly, in S1, the heat radiation control unit 71 determines whether or not a value of a heat radiation completion flag Frad_end is "1". The heat radiation completion flag Frad_end is a flag indicating a state in which the heat radiation control using the cooling water stored in the heat accumulator 51 is completed or a state in which execution of the heat radiation control is unnecessary. The value of the flag Frad_end is reset to "0" at startup of the engine 2. In addition, in the later-described processing of S8, the value of the flag Frad_end is set to "1" if the heat radiation control is completed or if execution of the heat radiation control is determined unnecessary. If a determination result of S1 is YES, i.e., if the heat radiation control is completed or if the heat radiation control is unnecessary, the heat radiation control unit 71 immediately terminates the processing of FIG. 3; if the determination result of S1 is NO, i.e., if the heat radiation control has not been completed, the heat radiation control unit 71 proceeds to S2. As described above, according to the heat radiation control processing of FIG. 3, during the period from when the engine 2 is started to when the engine 2 is stopped, the heat radiation control is executed at most once.

In S2, the heat radiation control unit 71 determines whether or not a value of a heat radiation control execution flag Frad is "1". The heat radiation control execution flag Frad is a flag indicating that the heat radiation control is being executed. The value of the flag Frad is reset to "0" when the engine 2 is started. In addition, the value of the flag Frad is set to "1" in the later-described processing of S7. If a determination result of S2 is NO, the heat radiation control unit 71 proceeds to S3; if YES, the heat radiation control unit 71 proceeds to S9.

In S3 and S4, the heat radiation control unit 71 determines whether or not a start condition of the heat radiation control is satisfied. More specifically, the heat radiation control unit 71 determines whether or not a cooling water temperature Tw acquired by using the cooling water temperature sensor 36 is lower than a predetermined heat radiation start temperature Trad (see S3). The heat radiation start temperature Trad is set to a temperature (specifically, e.g., Trad=50° C.) lower than the valve opening temperature Tth1 of the thermostatic valve 33. If the cooling water temperature Tw is equal to or higher than the heat radiation start temperature Trad, even if the cooling water stored in the heat accumulator 51 is supplied to the cooling circuit 3, the effects such as improvement of fuel efficiency of the engine 2 and so on cannot be obtained. Therefore, if a determination result of S3 is NO, the heat radiation control unit 71 determines that the engine 2 cannot be effectively warmed up even if the heat radiation control is executed, and proceeds to S8. In addition, if the determination result of S3 is YES, the heat radiation control unit 71 proceeds to S4.

In S4, the heat radiation control unit 71 acquires an end time water temperature Twes_m and determines whether or not the end time water temperature Twes_m is higher than the heat radiation start temperature Trad. The end time water temperature Twes_m is a temperature of the cooling water flowing out from the heat accumulator 51 at termination of the heat radiation control or heat storage control executed in the immediate past, and is stored in a memory (not shown) of the ECU 7 (e.g., see later-described S12 or S35). If a determination result of S4 is NO, the heat radiation control unit 71 determines that the engine 2 cannot be effectively warmed up even if the heat radiation control is executed, and proceeds to S8. In addition, if the determination result of S4 is YES, the heat radiation control unit 71 proceeds to S5 in order to start the heat radiation control.

In S5, the heat radiation control unit 71 opens the flow control valve 54 in order to start the heat radiation control, and proceeds to S6. Moreover, upon execution of the heat radiation control, the flow control valve 54 is preferably fully opened. In S6, the heat radiation control unit 71 turns on the electric pump 56, and proceeds to S7. As described above, in the heat radiation control, by opening the flow control valve 54 and further turning on the electric pump 56, the high temperature cooling water stored in the heat accumulator 51 by the heat storage control executed in the immediate past is supplied to the cooling circuit 3 to warm up the engine 2. In S7, the heat radiation control unit 71 sets the value of the heat radiation control execution flag Frad to "1" in order to clearly indicate that the heat radiation control is being executed, and proceeds to S13.

In S13, the heat radiation control unit 71 executes shutter control processing explained later with reference to FIG. 6, and terminates the processing of FIG. 3.

If the determination result of S3 or S4 is NO, the heat radiation control unit 71 determines that there is no need to execute the heat radiation control and proceeds to S8. In S8, the heat radiation control unit 71 sets the value of the heat radiation completion flag Frad_end to "1", and proceeds to S13. In S13, the shutter control processing is executed, and the processing of FIG. 3 is terminated.

If the determination result of S2 is YES, i.e., if the heat radiation control is continuously executed from the previous control cycle, the heat radiation control unit 71 proceeds to S9, and determines whether or not a timing for terminating the heat radiation control has arrived. More specifically, in S9, the heat radiation control unit 71 determines whether or not the cooling water temperature Tw is higher than a heat accumulator outlet water temperature Twes acquired using the heat accumulator water temperature sensor 55. When the heat radiation control is started, since the high temperature cooling water stored in the heat accumulator 51 is replaced with low temperature cooling water flowing through the cooling circuit 3, the heat accumulator outlet water temperature Twes drops. Meanwhile, the cooling water temperature Tw rises due to the cooling water supplied from the heat accumulator 51 and the waste heat of the engine 2. Therefore, if a determination result of S9 is NO, the heat radiation control unit 71 proceeds to S5 in order to continuously execute the heat radiation control. In addition, if the determination result of S9 is YES, the heat radiation control unit 71 determines that the timing for terminating the heat radiation control has arrived, and proceeds to S10.

In S10, the heat radiation control unit 71 closes the flow control valve 54 in order to terminate the heat radiation control, and proceeds to S11. Moreover, upon termination of the heat radiation control, the flow control valve 54 is preferably fully closed. In S11, the heat radiation control unit 71 turns off the electric pump 56, and proceeds to S12. In S12, the heat radiation control unit 71 stores, as the end time water temperature Twes_m, the heat accumulator outlet water temperature Twes at the time of termination of the heat radiation control in the memory of the ECU 7, and proceeds to S8.

Referring back to FIG. 1, the heat storage control unit 72 executes the heat storage control in which, by controlling the opening degree of the flow control valve 54 and an opening degree of the grille shutter 6 according to the cooling water temperature, the cooling water whose temperature is raised by the heat of the engine 2 is supplied from the cooling circuit 3 to the heat accumulator 51 via the introduction passage 52, and the high temperature cooling water is filled into the heat accumulator 51.

Figure 4:
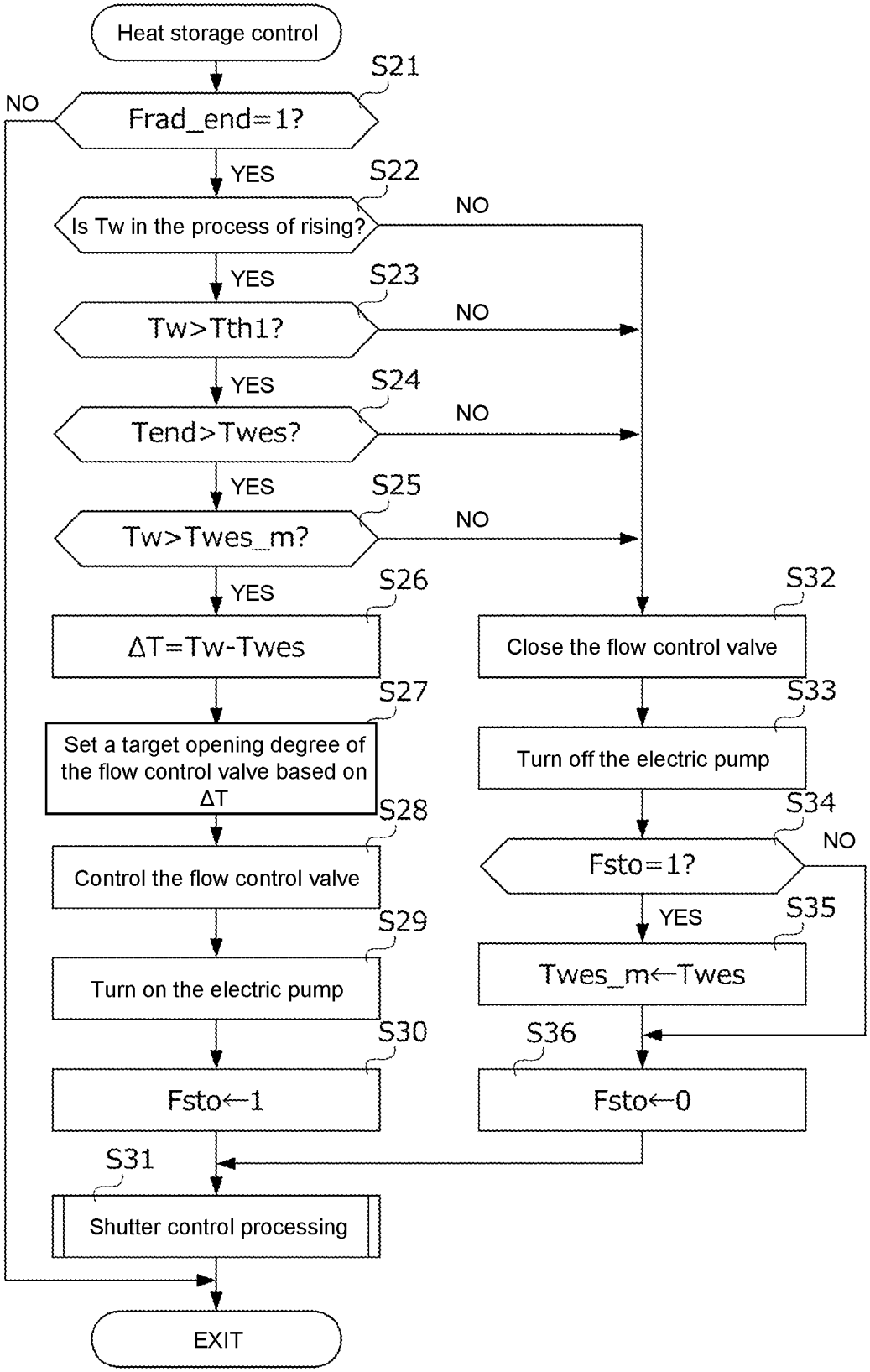
FIG. 4 is a flowchart showing a specific procedure of heat storage control.

FIG. 4 is a flowchart showing a specific procedure of the heat storage control performed by the heat storage control unit 72. Like the heat radiation control processing of FIG. 3, the heat storage control processing of FIG. 4 is repeatedly executed by the heat storage control unit 72 in a predetermined control cycle during the period from when the engine 2 is started to when the engine 2 is stopped.

Firstly, in S21, the heat storage control unit 72 determines whether or not the value of the heat radiation completion flag Frad_end is "1". If a determination result of S21 is NO, i.e., if the heat radiation control has not been completed, the heat storage control unit 72 immediately terminates the processing of FIG. 4. In addition, if the determination result of S21 is YES, i.e., if the heat radiation control is completed or if execution of the heat radiation control is determined unnecessary, the heat storage control unit 72 proceeds to S22.

In S22 to S25, the heat storage control unit 72 determines whether or not execution conditions of the heat storage control are satisfied. More specifically, in S22, the heat storage control unit 72 determines whether or not the cooling water temperature Tw is in the process of rising. More specifically, the heat storage control unit 72 determines whether or not the cooling water temperature Tw in the present control cycle is higher than the cooling water temperature Tw in the previous control cycle (present Tw>previous Tw?). If a determination result of S22 is YES, the heat storage control unit 72 determines that the cooling water temperature Tw is in the process of rising and that a timing suitable for executing the heat storage control has arrived, and proceeds to S23. In addition, if the determination result of S22 is NO, the heat storage control unit 72 determines that the cooling water temperature Tw is in the process of falling and that the timing suitable for executing the heat storage control has not arrived, and proceeds to S32.

In S23, the heat storage control unit 72 determines whether or not the cooling water temperature Tw is higher than the valve opening temperature Tth1 of the thermostatic valve 33. If a determination result of S23 is NO, the heat storage control unit 72 determines that the timing suitable for executing the heat storage control has not arrived, and proceeds to S32. If the determination result of S23 is YES, the heat storage control unit 72 determines that the timing suitable for executing the heat storage control has arrived, and proceeds to S24.

In S24, the heat storage control unit 72 determines whether or not the heat accumulator outlet water temperature Twes is lower than a predetermined end temperature Tend. When the heat storage control is executed, since the cooling water that has become hot due to the waste heat of the engine 2 is supplied from the cooling circuit 3 to the heat accumulator 51, the heat accumulator outlet water temperature Twes rises so as to approach the cooling water temperature Tw. Hence, whether or not a timing for terminating the heat storage control has arrived can be determined by using the end temperature Tend determined according to the cooling water temperature Tw and the heat accumulator outlet water temperature Twes. Therefore, if a determination result of S24 is NO, i.e., if the heat accumulator outlet water temperature Twes is equal to or higher than the end temperature Tend, the heat storage control unit 72 determines that the timing for terminating the heat storage control being executed has arrived, and proceeds to S32. In addition, if the determination result of S24 is YES, i.e., if the heat accumulator outlet water temperature Twes is lower than the end temperature Tend, the heat storage control unit 72 determines that the timing suitable for executing the heat storage control has arrived, and proceeds to S25.

Here, a preferable magnitude of the end temperature Tend is explained. When the heat storage control is continuously executed as described above, since the cooling water whose temperature is raised by the waste heat of the engine 2 is supplied from the cooling circuit 3 to the heat accumulator 51, the heat accumulator outlet water temperature Twes rises so as to approach the cooling water temperature Tw. However, in the process of flowing through the introduction passage 52 and the heat accumulator 51 until reaching the detection position of the heat accumulator water temperature sensor 55, the cooling water in the cooling circuit 3 is cooled due to heat radiation. Hence, when the heat storage control is continuously executed, it is conceivable that the heat accumulator outlet water temperature Twes converges to a temperature slightly lower than the cooling water temperature Tw. Therefore, the heat storage control unit 72 sets the end temperature Tend lower than the cooling water temperature Tw by a predetermined temperature, and determines this predetermined temperature by considering influence of the temperature drop due to heat radiation of the cooling water flowing through the introduction passage 52. More specifically, the predetermined temperature is, for example, 3° C.

In S25, the heat storage control unit 72 acquires the end time water temperature Twes_m and determines whether or not the end time water temperature Twes_m is lower than the cooling water temperature Tw. As described above, the end time water temperature Twes_m is the temperature of the cooling water stored in the heat accumulator 51 at termination of the heat radiation control or heat storage control executed in the immediate past, and is stored in the memory of the ECU 7 (e.g., see S12 of FIG. 3 or later-described S35). If a determination result of S25 is NO, the heat storage control unit 72 determines that the timing suitable for executing the heat storage control has not arrived, and proceeds to S32. In addition, if the determination result of S25 is YES, the heat storage control unit 72 determines that the timing suitable for executing the heat storage control has arrived, and proceeds to S26.

As described above, if all the four heat storage control execution conditions of S22 to S25 are satisfied, the heat storage control unit 72 proceeds to S26 in order to execute the heat storage control. In S26, the heat storage control unit 72 calculates a temperature difference ΔT between the cooling water temperature Tw and the heat accumulator outlet water temperature Twes by subtracting the heat accumulator outlet water temperature Twes from the cooling water temperature Tw, and proceeds to S27. In S27, the heat storage control unit 72 determines a target opening degree of the flow control valve 54 according to the temperature difference ΔT, and proceeds to S28. More specifically, the heat storage control unit 72 determines the target opening degree corresponding to the temperature difference ΔT by searching a map as exemplified in FIG. 5 based on the temperature difference ΔT. According to the map of FIG. 5, the target opening degree of the flow control valve 54 becomes maximum (i.e., fully opened) when the temperature difference ΔT is 0. In addition, according to the map of FIG. 5, the target opening degree of the flow control valve 54 is set to a closing side as the temperature difference ΔT increases, i.e., the target opening degree is set to the closing side as the cooling water temperature Tw increases with respect to the heat accumulator outlet water temperature Twes. More specifically, if the temperature difference ΔT is 50° C. or less, the target opening degree is set to the closing side as the temperature difference ΔT increases. In addition, if the temperature difference ΔT is larger than 50° C., the target opening degree is set to be constant at a heat storage minimum opening degree set to an opening side rather than the fully closed state, regardless of the temperature difference ΔT.

Here, an advantage of setting the target opening degree of the flow control valve 54 during execution of the heat storage control based on the temperature difference ΔT is explained. When the flow control valve 54 is opened in the heat storage control, the cooling water in an amount corresponding to the opening degree of the flow control valve 54 flows to the second cooling water passage 31*b* of the cooling circuit 3 via the discharge passage 53 of the heat storage system 5. Accordingly, when the opening degree of the flow control valve 54 is increased in a state in which the temperature difference ΔT is large, i.e., the difference between the cooling water temperature Tw and the heat accumulator outlet water temperature Twes is large, cold cooling water may flow into the second cooling water passage 31*b* and the temperature of the warmed-up engine 2 may greatly drop. On the other hand, in a state in which the temperature difference ΔT is small, even if the opening degree of the flow control valve 54 is increased, the temperature of the engine 2 does not greatly drop. Therefore, the heat storage control unit 72 sets the target opening degree of the flow control valve 54 during execution of the heat storage control based on the temperature difference ΔT, and sets the target opening degree to the closing side as the temperature difference ΔT increases as described above.

Referring back to FIG. 4, in S28, the heat storage control unit 72 controls the opening degree of the flow control valve 54 to be the target opening degree determined in S27, and proceeds to S29. In S29, the heat storage control unit 72 turns on the electric pump 56, and proceeds to S30. As described above, in the heat storage control, by opening the flow control valve 54 to an opening degree corresponding to the temperature difference ΔT and further turning on the electric pump 56, the cooling water of the cooling circuit 3 warmed by the waste heat of the engine 2 is supplied to the heat accumulator 51.

In S30, the heat storage control unit 72 sets a value of a heat storage control execution flag Fsto to "1", and proceeds to S31. The heat storage control execution flag Fsto is a flag indicating that the heat storage control is being executed. The value of the flag Fsto is reset to "0" when the engine 2 is started and when the heat storage control is terminated (see later-described S36).

In S31, the heat storage control unit 72 executes the shutter control processing explained later with reference to FIG. 6, and terminates the processing of FIG. 4.

In addition, if any one of the four heat storage control execution conditions of S22 to S25 is not satisfied, the heat storage control unit 72 proceeds to S32 and does not execute the heat storage control. That is, in S32, the heat storage control unit 72 closes the flow control valve 54 so as to prevent the cooling water from flowing from the cooling circuit 3 to the heat accumulator 51, and proceeds to S33. Moreover, during non-execution of the heat storage control, the flow control valve 54 is preferably fully closed. In S33, the heat storage control unit 72 turns off the electric pump 56, and proceeds to S34.

In S34, the heat storage control unit 72 determines whether or not the value of the heat storage control execution flag Fsto is "1". If a determination result of S34 is YES, i.e., if any one of the four heat storage control execution conditions of S22 to S25 is not satisfied for the first time in the present control cycle and the heat storage control that has been executed so far is terminated, the heat storage control unit 72 proceeds to S35. If the determination result of S34 is NO, i.e., if the heat storage control is not continuously executed from the previous control cycle, the heat storage control unit 72 proceeds to S36.

In S35, the heat storage control unit 72 stores, as the end time water temperature Twes_m, the heat accumulator outlet water temperature Twes at the time of termination of the heat storage control in the memory of the ECU 7, and proceeds to S36. In S36, the heat storage control unit 72 resets the value of the heat storage control execution flag Fsto to "0", and proceeds to S31.

According to the above, the heat storage control unit 72 executes the heat storage control on condition that the cooling water temperature Tw is in the process of rising and that the cooling water temperature Tw is higher than the valve opening temperature Tth1 of the thermostatic valve 33 (see S22 and S23). In addition, after starting the heat storage control, the heat storage control unit 72 continuously performs the heat storage control until the heat accumulator outlet water temperature Twes reaches the end temperature Tend lower than the cooling water temperature Tw by the predetermined temperature (see S24).

Figure 5:
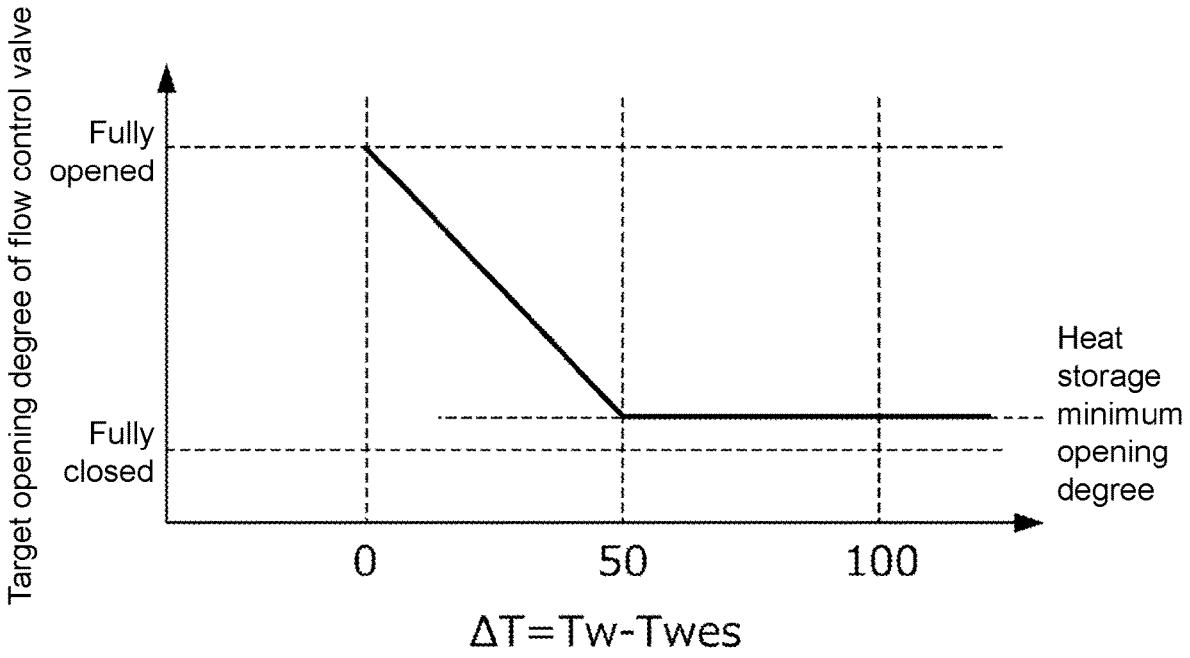
FIG. 5 is an example of a map determining a target opening degree of a flow control valve.

In addition, the heat storage control unit 72 determines the target opening degree of the flow control valve 54 during execution of the heat storage control by searching the map shown in FIG. 5 based on the temperature difference ΔT between the cooling water temperature Tw and the heat accumulator outlet water temperature Twes. If the flow control valve 54 is largely opened when a deviation between the cooling water temperature Tw and the heat accumulator outlet water temperature Twes is large, there is a fear that the flow rate of the cooling water flowing from the heat accumulator 51 to the second cooling water passage 31*b* of the cooling circuit 3 may increase and the temperature of the engine 2 after warm-up may greatly drop. By determining the target opening degree of the flow control valve 54 based on the temperature difference ΔT, the heat storage control unit 72 avoids a great drop in the temperature of the engine 2.

In the case where no heat storage control is executed for a long time, the temperature of the cooling water in the discharge passage 53 may drop, and the heat accumulator outlet water temperature Twes detected by the heat accumulator water temperature sensor 55 sometimes also drops. In this case, since the temperature difference ΔT increases and the target opening degree of the flow control valve 54 during execution of the heat storage control is set to the heat storage minimum opening degree close to the opening degree in the fully closed state, the flow rate of the cooling water flowing through the discharge passage 53 is reduced to a minimum. That is, in the heat accumulator water temperature sensor 55, since the cooling water flows from the heat accumulator 51 at a small flow rate at first, the heat accumulator outlet water temperature Twes can be updated while unnecessary heat radiation of the cooling water in the heat accumulator 51 is reduced to the minimum.

Figure 6:
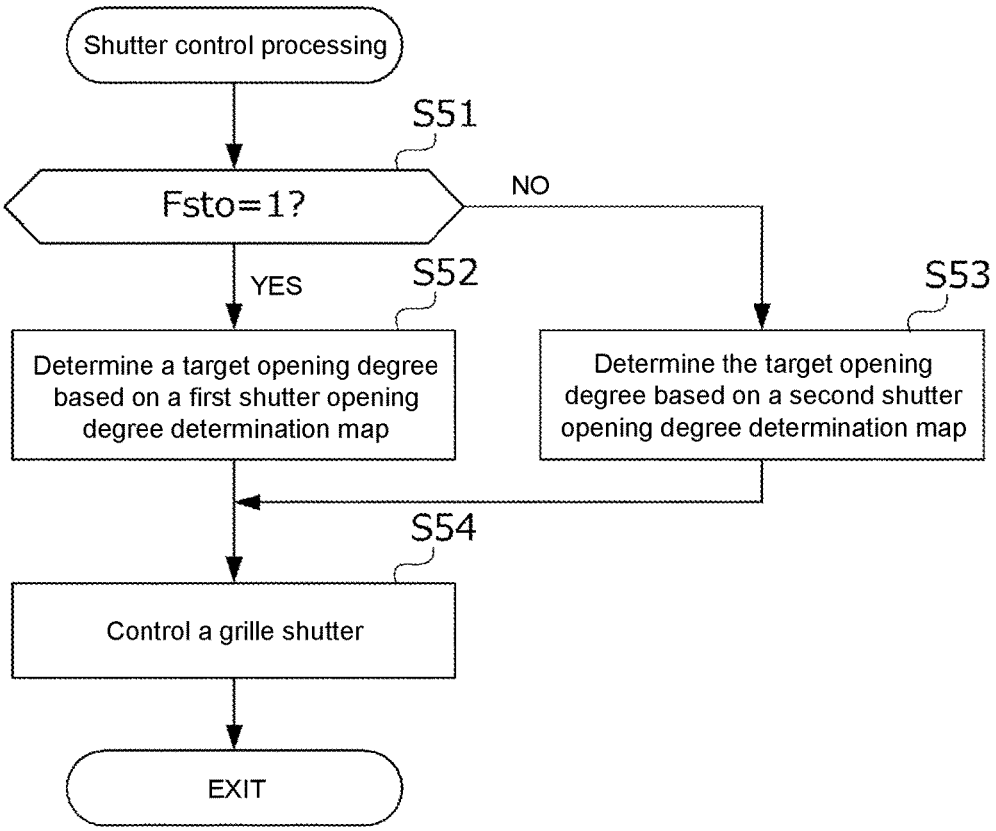
FIG. 6 is a flowchart showing a specific procedure of shutter control processing.

FIG. 6 is a flowchart showing a specific procedure of the shutter control processing being a subroutine of the heat radiation control processing of FIG. 3 and the heat storage control processing of FIG. 4. Two types of shutter opening degree determination maps for associating the cooling water temperature Tw with a target opening degree of the grille shutter 6 are stored in the ECU 7. The ECU 7 adjusts the opening degree of the grille shutter 6 by using these two shutter opening degree determination maps.

In S51, the ECU 7 determines whether or not the value of the heat storage control execution flag Fsto is "1", i.e., whether or not the heat storage control is being executed. If a determination result of S51 is YES, the ECU 7 proceeds to S52; if NO, the ECU 7 proceeds to S53.

In S52, the ECU 7 determines the target opening degree of the grille shutter 6 based on a first shutter opening degree determination map (see FIG. 7A) predetermined for execution of the heat storage control, and proceeds to S54. More specifically, the ECU 7 determines the target opening degree of the grille shutter 6 by searching the first shutter opening degree determination map based on the cooling water temperature Tw.

In S53, the ECU 7 determines the target opening degree of the grille shutter 6 based on a second shutter opening degree determination map (see FIG. 7B) predetermined for normal use (i.e. for non-execution of the heat storage control), and proceeds to S54. More specifically, the ECU 7 determines the target opening degree of the grille shutter 6 by searching the second shutter opening degree determination map based on the cooling water temperature Tw. In S54, the ECU 7 controls the opening degree of the grille shutter 6 so that the target opening degree set in S52 or S53 is realized, and terminates the processing of FIG. 6.

Figure 7A:
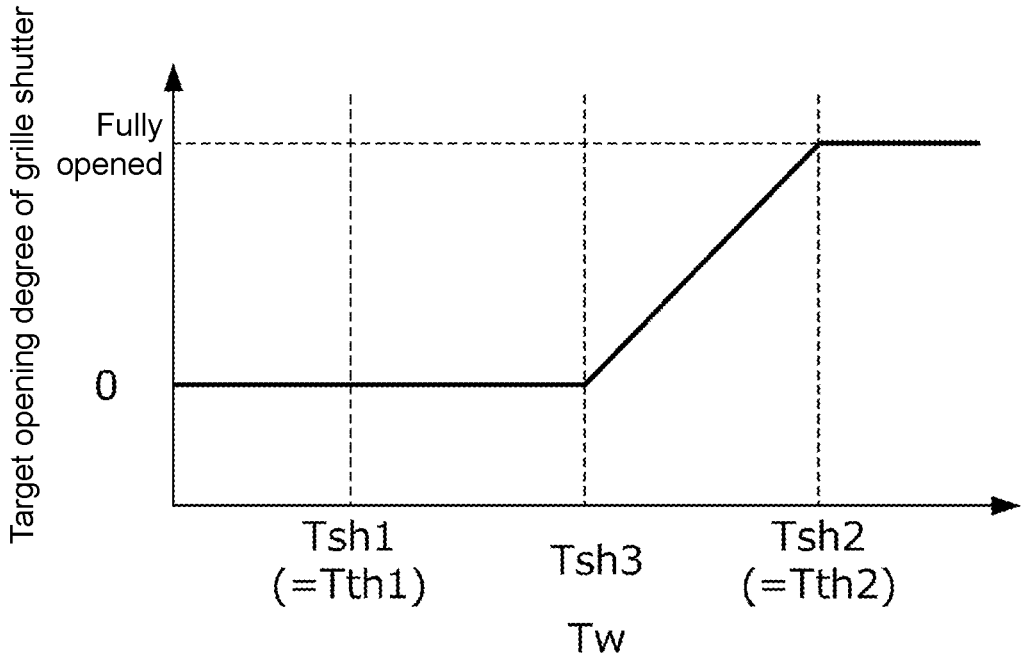
FIG. 7A is an example of a first shutter opening degree determination map determined for execution of the heat storage control.
Figure 7B:
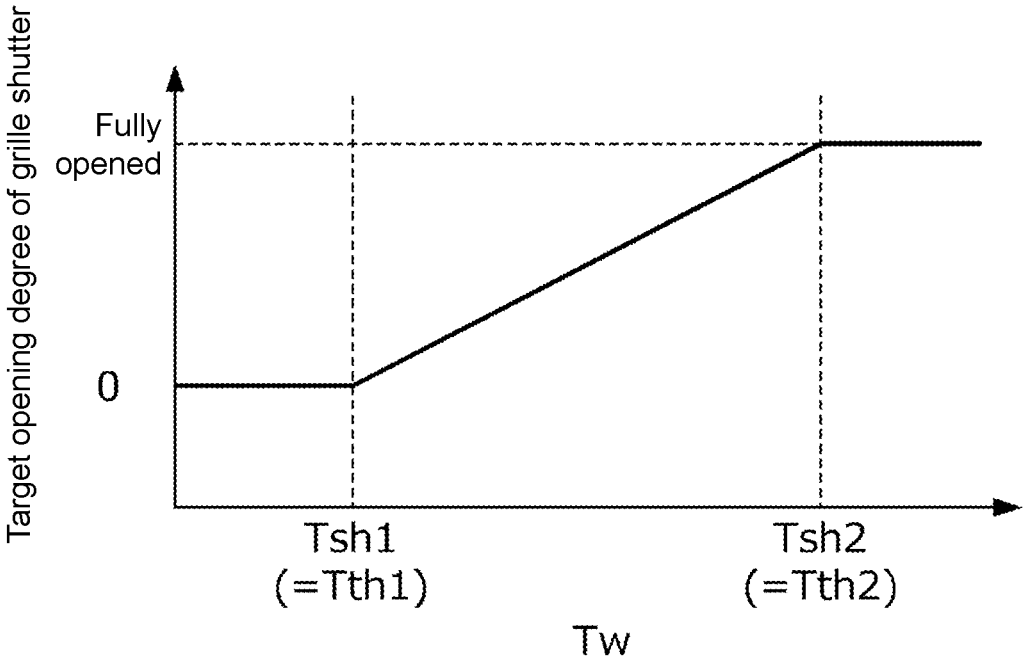
FIG. 7B is an example of a second shutter opening degree determination map determined for normal use.

FIG. 7A illustrates an example of the first shutter opening degree determination map selected when the heat storage control is being executed. FIG. 7B illustrates an example of the second shutter opening degree determination map selected when the heat storage control is not being executed. Hereinafter, configurations of the first and second shutter opening degree determination maps are explained.

As shown in FIG. 7B, in the case where the heat storage control is not being executed, the ECU 7 controls the grille shutter 6 to be in the fully closed state when the cooling water temperature Tw is equal to or lower than a predetermined shutter opening temperature Tsh1, and controls the grille shutter 6 to be in an opened state when the cooling water temperature Tw is higher than the shutter opening temperature Tsh1. More specifically, the ECU 7 controls the grille shutter 6 to be in the fully opened state when the cooling water temperature Tw is higher than a predetermined shutter fully opening temperature Tsh2, and controls the grille shutter 6 to an opening side as the cooling water temperature Tw gets higher when the cooling water temperature Tw is higher than the shutter opening temperature Tsh1 and equal to or lower than the shutter fully opening temperature Tsh2. Moreover, as shown in FIG. 7B, in the case where the heat storage control is not being executed, the shutter opening temperature Tsh 1 of the grille shutter 6 is set almost equal to the valve opening temperature Tth1 of the thermostatic valve 33, and the shutter fully opening temperature Tsh2 is set almost equal to the full-open temperature Tth2 of the thermostatic valve 33.

As shown in FIG. 7A, in the case where the heat storage control is being executed, the ECU 7 controls the grille shutter 6 to be in the fully closed state when the cooling water temperature Tw is equal to or lower than a shutter opening temperature Tsh3 set higher than the temperature Tsh1 shown in FIG. 7B, and controls the grille shutter 6 to be in the opened state when the cooling water temperature Tw is higher than the shutter opening temperature Tsh3. More specifically, the ECU 7 controls the grille shutter 6 to be in the fully opened state when the cooling water temperature Tw is higher than the above shutter fully opening temperature Tsh2, and controls the grille shutter 6 to the opening side as the cooling water temperature Tw gets higher when the cooling water temperature Tw is higher than the shutter opening temperature Tsh3 and equal to or lower than the shutter fully opening temperature Tsh2.

As shown in FIG. 7A, the shutter opening temperature Tsh3 during execution of the heat storage control is set higher than the valve opening temperature Tth1 of the thermostatic valve 33. Accordingly, the ECU 7 controls the grille shutter 6 to be in the fully closed state when the cooling water temperature Tw is lower than the valve opening temperature Tth1 of the thermostatic valve 33. Accordingly, since heat radiation from the engine 2 to the outside air in a warm-up process before the thermostatic valve 33 starts to open can be suppressed, the temperature of the cooling water flowing through the cooling circuit 3 can be promptly raised, and the high temperature cooling water can be secured in the heat accumulator 51 in an early stage.

In addition, as shown in FIG. 7A, the shutter opening temperature Tsh3 during execution of the heat storage control is set higher than the shutter opening temperature Tsh1 and lower than the shutter fully opening temperature Tsh2 during non-execution of the heat storage control. That is, in the case where the heat storage control is being executed, the grille shutter 6 is maintained in the fully closed state until reaching a temperature higher than that in the case where the heat storage control is not being executed. Accordingly, during execution of the heat storage control intended to secure the cooling water having a temperature as high as possible, the shutter opening temperature can be raised, and the cooling water temperature Tw can be more easily raised. In addition, if the heat storage control is not executed and there is no need to secure high temperature cooling water in the heat accumulator 51, the shutter opening temperature can be lowered, heat radiation of the engine 2 by the outside air can be promoted, so that cooling of the engine 2 by the radiator 35 can be prevented from being hindered.

Figure 8:
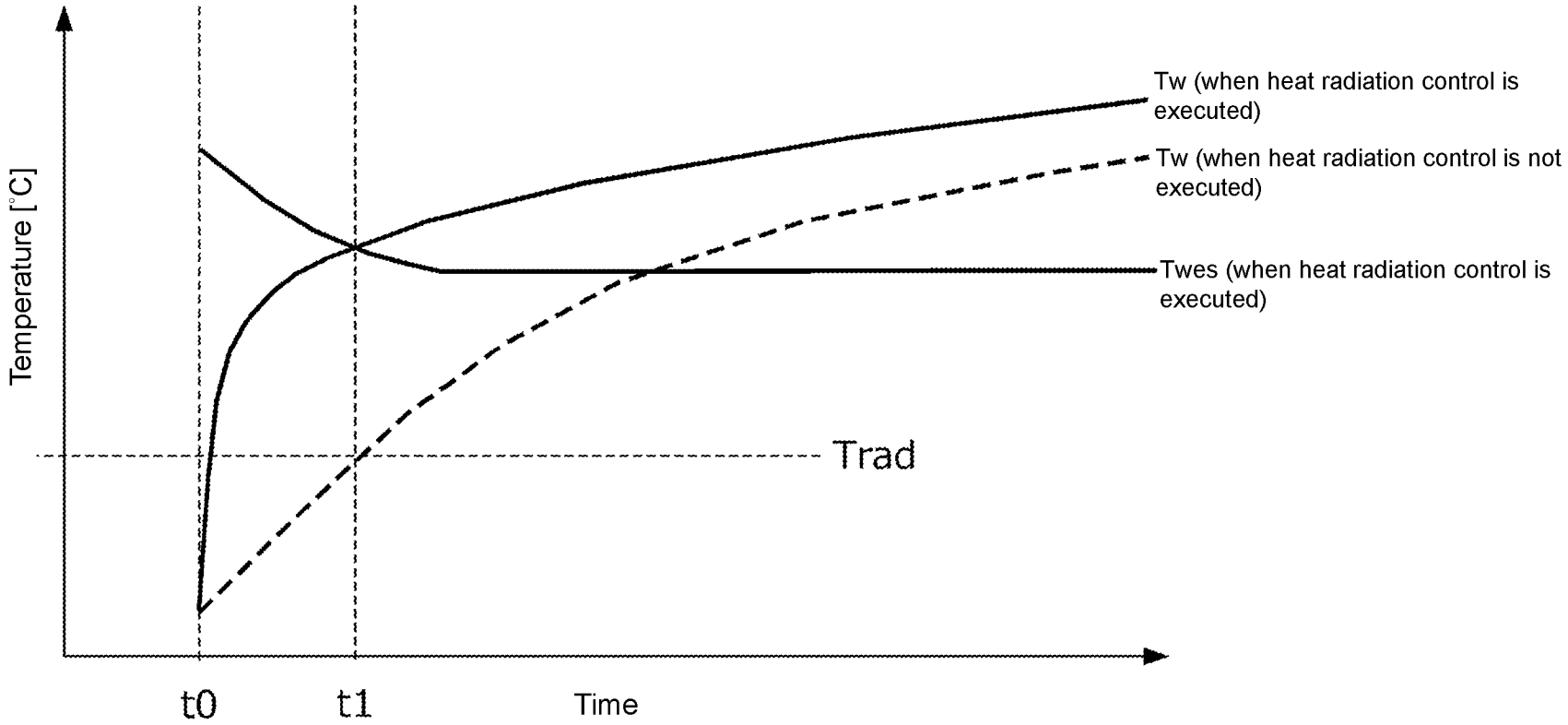
FIG. 8 is a time chart showing a specific example of the heat radiation control of FIG. 3.

FIG. 8 is a time chart showing a specific example of the heat radiation control of FIG. 3. FIG. 8 shows changes in the cooling water temperature Tw and the heat accumulator outlet water temperature Twes immediately after startup of the engine 2. Moreover, in FIG. 8, the heat accumulator outlet water temperature Twes and the cooling water temperature Tw in the case where the heat radiation control is performed are indicated in solid lines, and the cooling water temperature Tw in the case where the heat radiation control is not performed is indicated in broken lines.

In the example of FIG. 8, the engine 2 is started at time t0. At time t0, according to a determination that the cooling water temperature Tw is lower than the predetermined heat radiation start temperature Trad (see S3 of FIG. 3), the heat radiation control unit 71 starts the heat radiation control in which the flow control valve 54 is opened and the electric pump 56 is turned on, the high temperature cooling water stored in the heat accumulator 51 is supplied to the cooling circuit 3 and warm-up of the engine 2 is promoted. Accordingly, from time t0 onward, the cooling water temperature Tw rises due to the cooling water supplied from the heat accumulator 51. Also, from time t0 onward, since cold cooling water is supplied from the cooling circuit 3 to the heat accumulator 51, the heat accumulator outlet water temperature Twes drops.

After that, at time t1, according to a determination that the heat accumulator outlet water temperature Twes becomes lower than the cooling water temperature Tw (see S9 of FIG. 3), the heat radiation control unit 71 closes the flow control valve 54, turns off the electric pump 56, and terminates the heat radiation control. Accordingly, from time t1 onward, the heat accumulator outlet water temperature Twes becomes substantially constant, and the cooling water temperature Tw gradually rises due to the waste heat of the engine 2. As shown in FIG. 8, by executing the heat radiation control, the cooling water temperature Tw can be more promptly raised than in the case where the heat radiation control is not executed, and the engine 2 can be warmed up in the early stage.

Figure 9:
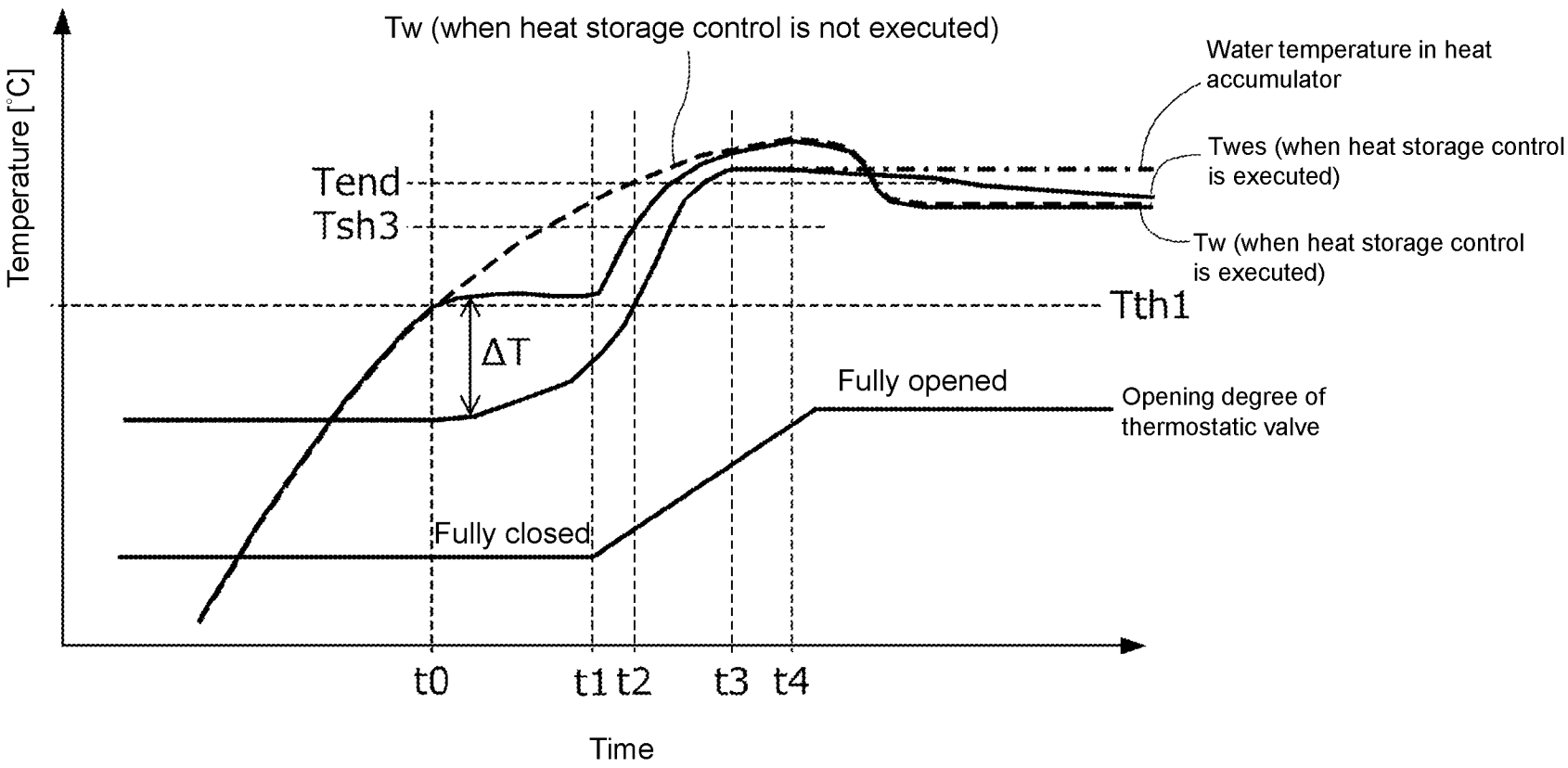
FIG. 9 is a time chart showing a specific example of the heat storage control of FIG. 4.

FIG. 9 is a time chart showing a specific example of the heat storage control of FIG. 4. FIG. 9 shows a change in the opening degree of the thermostatic valve 33 in a process in which the cooling water temperature rises after startup of the engine 2. Moreover, in FIG. 9, the heat accumulator outlet water temperature Twes and the cooling water temperature Tw in the case where the heat storage control is performed are indicated in solid lines, and the cooling water temperature Tw in the case where the heat storage control is not performed is indicated in broken lines.

In the example of FIG. 9, the cooling water temperature Tw exceeds the valve opening temperature Tth1 of the thermostatic valve 33 at time t0. Accordingly, from time t0 onward, the thermostatic valve 33 starts to open. Also, from time t0 onward, according to the fact that the cooling water temperature Tw is in the process of rising (see S22 of FIG. 4) and that the cooling water temperature Tw is higher than the valve opening temperature Tth1 of the thermostatic valve 33 (see S23 of FIG. 4), the heat storage control unit 72 starts the heat storage control in which the flow control valve 54 is rendered in the opened state and the electric pump 56 is turned on, and the cooling water in the cooling circuit 3 is supplied to the heat accumulator 51.

In the heat storage control executed after time t0, the heat storage control unit 72 sets the target opening degree of the flow control valve 54 based on the temperature difference ΔT between the cooling water temperature Tw and the heat accumulator outlet water temperature Twes. More specifically, the heat storage control unit 72 sets the target opening degree to the closing side as the temperature difference ΔT increases. Hence, since the flow control valve 54 immediately after the start of the heat storage control is controlled to the heat storage minimum opening degree close to the opening degree in the fully closed state, the flow rate of the cooling water pushed out from the heat accumulator 51 to the cooling circuit 3 is also reduced. When the heat storage control is executed in the state in which the temperature difference ΔT is large, since cold cooling water is supplied to the cooling circuit 3, the temperature of the engine 2 drops, and the cooling water temperature Tw sometimes turns to decrease. With respect to this, by setting the opening degree of the flow control valve 54 to the closing side as the temperature difference ΔT increases as described above, as shown in FIG. 9, the heat storage control unit 72 is capable of maintaining the cooling water temperature Tw immediately after the start of the heat storage control constant in the vicinity of the valve opening temperature Tth1 of the thermostatic valve 33 so as to prevent the cooling water temperature Tw from turning to decrease. Hence, according to the present embodiment, as shown in FIG. 9, after the heat storage control is started at time to, the thermostatic valve 33 is maintained in an almost fully closed state until the temperature difference ΔT decreases.

After that, at time t1, the cooling water temperature Tw starts to rise from the valve opening temperature Tth1 of the thermostatic valve 33 due to the waste heat of the engine 2, whereby the thermostatic valve 33 also starts to open. Also, from time t1 onward, by supplying the cooling water whose temperature is raised by the waste heat of the engine 2 from the cooling circuit 3 to the heat accumulator 51, the heat accumulator outlet water temperature Twes rises together with the cooling water temperature Tw.

After that, at time t3, the heat storage control unit 72 determines that the heat accumulator outlet water temperature Twes becomes equal to or higher than the end temperature Tend set lower than the cooling water temperature Tw by the predetermined temperature (refer to S24 in FIG. 4), accordingly closes the flow control valve 54 and turns off the electric pump 56, and terminates the heat storage control. Accordingly, from time t3 onward, since the cooling water in the discharge passage 53 is gradually cooled by the outside air, as shown in FIG. 9, the heat accumulator outlet water temperature Twes detected by the heat accumulator water temperature sensor 55 gradually drops. However, since the cooling water in the heat accumulator 51 is stored in the reservoir having the heat retention function, as indicated by a dot-and-dash line in FIG. 9, the temperature of the cooling water is maintained substantially constant at a temperature at the time of terminating the heat storage control.

In addition, as explained with reference to FIG. 6, between time t0 and t3 during which the heat storage control is executed, the target opening degree of the grille shutter 6 is determined by searching the first shutter opening degree determination map shown in FIG. 7A based on the cooling water temperature Tw at that time. Hence, the grille shutter 6 is controlled to be in the fully closed state during a period until time t2 at which the cooling water temperature Tw exceeds the shutter opening temperature Tsh3. Hence, since heat radiation of the engine 2 is suppressed between time t0 and t3 during which the heat storage control is executed, high temperature cooling water can be secured in the heat accumulator 51.

As described above, the thermostatic valve 33 gradually starts to open from time t1 onward, and the grille shutter 6 gradually starts to open from time t2 onward. Hence, the engine 2 and the cooling water flowing through the cooling circuit 3 are cooled by the radiator 35 and the outside air flowing in from the front grille G. Hence, as shown in FIG. 9, the cooling water temperature Tw sometimes turns to decrease at time t4. With respect to this, in the thermal management system 1, by terminating the heat storage control at time t3 at which the heat accumulator outlet water temperature Twes reaches the end temperature Tend set lower than the cooling water temperature Tw by the predetermined temperature, the high temperature cooling water before the temperature turns to decrease can be secured in the heat accumulator 51.

According to the thermal management system 1 of the present embodiment, the following effects are achieved.

(1) In the thermal management system 1, the heat accumulator 51 storing the cooling water and the radiator 35 are connected to the cooling circuit 3 of the engine 2, the flow rate of the cooling water flowing from the cooling circuit 3 to the heat accumulator 51 is adjusted by the flow control valve 54, and the flow rate of the cooling water flowing from the cooling circuit 3 to the radiator 35 is adjusted by the thermostatic valve 33. In addition, the amount of the outside air introduced from the front grille G into the engine room R is adjusted by the grille shutter 6. In such a thermal management system 1, since the amount of the outside air introduced from the front grille G into the engine room R is limited when the grille shutter 6 is closed, the amount of heat radiated from the engine 2 to the outside air is reduced, and the temperature of the cooling water flowing through the cooling circuit 3 rises. However, when the grille shutter 6 is continuously closed, the temperature of the cooling water may excessively rise, and there is a fear that cooling of the engine 2 by the radiator 35 may be hindered. In addition, when the flow control valve 54 is opened, the cooling water flowing through the cooling circuit 3, whose temperature is raised by the waste heat of the engine 2, is supplied to the heat accumulator 51. However, when the cooling circuit 3 and the heat accumulator 51 are connected in this way, since the amount of the cooling water in the entire system increases as much as the capacity of the heat accumulator 51, warm-up of the engine 2 is delayed accordingly. In addition, when the cooling water is supplied from the cooling circuit 3 to the heat accumulator 51, since low temperature cooling water stored in the heat accumulator 51 is pushed out to the cooling circuit 3, the temperature of the cooling water flowing through the cooling circuit 3 may drop, and there is a fear that the temperature of the engine 2 may excessively drop.

Therefore, by controlling the opening degree of the flow control valve 54 and the opening degree of the grille shutter 6 according to the cooling water temperature Tw, the heat storage control unit 72 executes the heat storage control for supplying the cooling water from the cooling circuit 3 to the heat accumulator 51. Thus, according to the thermal management system 1, high temperature cooling water can be stored in the heat accumulator 51 while warm-up and cooling of the engine 2 are prevented from being hindered. In addition, when the engine is cold, the heat radiation control unit 71 supplies the high temperature cooling water stored in the heat accumulator 51 to the cooling circuit 3 as described above, and warms up the engine 2 through heat exchange with the high temperature cooling water. Accordingly, fuel efficiency of the vehicle V can be improved and the burden on an exhaust gas purifier of the engine 2 can further be reduced.

(2) When the cooling water temperature Tw is lower than the valve opening temperature Tth1 of the thermostatic valve 33, i.e., before cooling of the cooling water by the radiator 35 is started, the heat storage control unit 72 controls the grille shutter 6 to be in the fully closed state. Accordingly, since heat radiation from the engine 2 to the outside air in the warm-up process can be suppressed, the temperature of the cooling water flowing through the cooling circuit 3 can be promptly raised, and the high temperature cooling water can be secured in the heat accumulator 51 in an early stage.

(3) The heat storage control unit 72 starts the heat storage control on condition that the cooling water temperature Tw is equal to or higher than the valve opening temperature Tth1 of the thermostatic valve 33, and after that, terminates the heat storage control according to the fact that the heat accumulator outlet water temperature Twes exceeds the end temperature Tend determined lower than the cooling water temperature Tw by the predetermined temperature. Accordingly, the cooling water whose temperature is raised in the process of closing the thermostatic valve 33 and warming up the engine 2 can be stored in the heat accumulator 51. In addition, when the heat storage control is executed in this way, since the cooling water whose temperature is raised by the waste heat of the engine 2 is supplied from the cooling circuit 3 to the heat accumulator 51, the temperature of the cooling water stored in the heat accumulator 51 rises and the heat accumulator outlet water temperature Twes rises. However, in the process during which the cooling water flows from the cooling circuit 3 to the heat accumulator 51, the temperature of the cooling water drops due to heat radiation. Hence, it is conceivable that the heat accumulator outlet water temperature Twes reaches a temperature slightly lower than the cooling water temperature Tw. Therefore, after starting the heat storage control, in the case where the heat accumulator outlet water temperature Twes becomes equal to or higher than the end temperature Tend determined lower than the cooling water temperature Tw by the predetermined temperature (e.g., 3° C.), the heat storage control unit 72 terminates the heat storage control. Accordingly, while the cooling water heated by the engine 2 is secured in the heat accumulator 51, the heat storage control can be terminated at an appropriate timing.

(4) When the heat storage control is executed in a state in which the heat accumulator outlet water temperature Twes is excessively lower than the cooling water temperature Tw, the high temperature cooling water from the cooling circuit 3 flows into the heat accumulator 51, and the low temperature cooling water pushed out from the heat accumulator 51 flows into the cooling circuit 3. Hence, the temperature of the cooling water flowing through the cooling circuit 3 drops, the temperature of the engine 2 drops, and there is a fear that fuel efficiency may deteriorate or the burden on an exhaust gas purifier may increase. Therefore, the heat storage control unit 72 sets the target opening degree of the flow control valve 54 toward the closing side as the temperature difference ΔT obtained by subtracting the heat accumulator outlet water temperature Twes from the cooling water temperature Tw increases, so as to make it difficult for the cooling water to flow from the heat accumulator 51 to the cooling circuit 3. Thus, according to the thermal management system 1, by executing the heat storage control, the opening degree of the flow control valve 54 can be adjusted so as to prevent an excessive drop in the temperatures of the cooling water flowing through the cooling circuit 3 and the engine 2 exchanging heat with the cooling water, and high temperature cooling water can be secured in the heat accumulator 51 while deterioration in fuel efficiency or increase in burden on the exhaust gas purifier is prevented.

(5) The heat storage control unit 72 executes the heat storage control when the cooling water temperature Tw is in the process of rising, and supplies the cooling water from the cooling circuit 3 to the heat accumulator 51. In addition, the heat storage control unit 72 does not execute the heat storage control when the cooling water temperature Tw is in the process of falling, so that the cooling water is not supplied from the cooling circuit 3 to the heat accumulator 51. Accordingly, according to the thermal management system 1, since the cooling water can be supplied to the heat accumulator 51 in the middle of a temperature rise, the cooling water having a temperature as high as possible can be secured in the heat accumulator 51.

(6) The heat storage control unit 72 sets the shutter opening temperature Tsh3 during execution of the heat storage control higher than the shutter opening temperature Tsh1 during non-execution of the heat storage control. Accordingly, during execution of the heat storage control intended to secure the cooling water having a temperature as high as possible in the heat accumulator 51, heat radiation of the engine 2 can be suppressed, and the cooling water temperature Tw can be more easily raised. In addition, if the heat storage control is not being executed and there is no need to secure high temperature cooling water in the heat accumulator 51, heat radiation of the engine 2 can be promoted, so that cooling of the cooling water by the radiator 35 and cooling of the engine 2 can be prevented from being hindered.

(7) The heat storage control unit 72 stores the heat accumulator outlet water temperature Twes at termination of the heat storage control as the end time water temperature Twes_m, and, if the cooling water temperature Tw becomes higher than the end time water temperature Twes_m after termination of the heat storage control, executes the heat storage control again. The temperature of the cooling water flowing through the cooling circuit 3 may rise or drop depending on an operating state of the engine 2 or the like. With respect to this, according to the thermal management system 1, since the temperature of the cooling water stored in the heat accumulator 51 can accumulate according to the operating state of the engine 2, the cooling water having a highest temperature in a use state of the engine 2 at that time can be secured in the heat accumulator 51.

Second Embodiment

Hereinafter, a second embodiment of the disclosure is explained with reference to the drawings.

Figure 10:
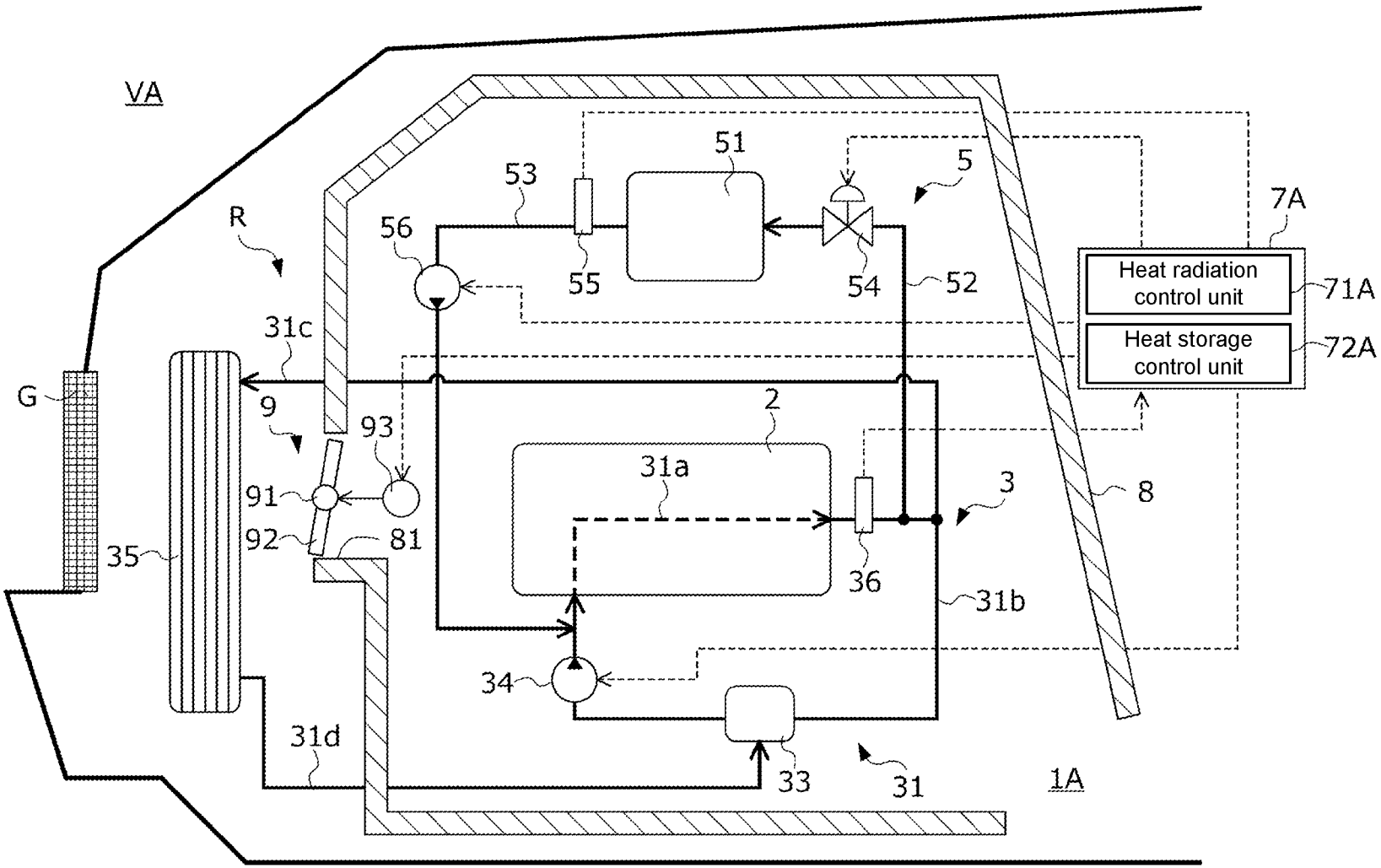
FIG. 10 illustrates a configuration of a thermal management system and a vehicle equipped with this thermal management system according to a second embodiment of the disclosure.

FIG. 10 illustrates a configuration of a thermal management system 1A and a vehicle VA equipped with the thermal management system 1A according to the present embodiment. Moreover, in the following explanation of the thermal management system 1A, the same components as those of the thermal management system 1 according to the first embodiment are denoted by the same reference numerals and explanations thereof are omitted.

The thermal management system 1A includes the cooling circuit 3, the heat storage system 5, a heat storage capsule 8 provided in the engine room R, an outside air shutter 9 provided in the heat storage capsule 8, and an ECU 7A controlling the cooling circuit 3, the heat storage system 5 and the outside air shutter 9.

The heat storage capsule 8 is an insulating container made of a heat insulating material and accommodates at least the engine 2. More specifically, the heat storage capsule 8 accommodates the engine 2, a part of the cooling circuit 3, and the heat storage system 5. An outside air inlet 81 is formed in a portion of the heat storage capsule 8 facing the front grille G.

The outside air shutter 9 includes: a rotation shaft 91 provided at the outside air inlet 81, a platelike shutter member 92 provided rotatably about the rotation shaft 91, and an electric actuator 93 rotating the shutter member 92 about the rotation shaft 91 according to a command signal transmitted from the ECU 7A.

When an opening degree of the shutter member 92 is set to a predetermined full-close opening degree by the electric actuator 93, as shown in FIG. 10, the shutter member 92 becomes substantially parallel to an opening plane of the outside air inlet 81. Accordingly, an introduction amount of traveling wind flowing from the front grille G into the engine room R and further flowing from the outside air inlet 81 into the heat storage capsule 8 becomes minimum. When the opening degree of the shutter member 92 is set to a predetermined full-open opening degree by the electric actuator 93, the shutter member 92 becomes substantially perpendicular to the opening plane of the outside air inlet 81. Accordingly, the amount of traveling wind introduced from the outside air inlet 81 into the heat storage capsule 8 becomes maximum. Accordingly, under the control of the ECU 7A, the amount of the traveling wind introduced from the front grille G into the engine room R can be adjusted by controlling the opening degree of the shutter member 92 between the full-close opening degree and the full-open opening degree.

Moreover, specific procedures of the heat radiation control processing, the heat storage control processing and the shutter control processing executed in a heat radiation control unit 71A and a heat storage control unit 72A of the ECU 7A are almost the same as those in the flowcharts of FIG. 3, FIG. 4 and FIG. 6, respectively. More specifically, the shutter control processing in the present embodiment is different from the shutter control processing in the first embodiment in that the amount of the traveling wind introduced into the heat storage capsule 8 is adjusted by the outside air shutter 9, and the two are the same in other respects.

In the thermal management system 1A according to the present embodiment, at least the engine 2 is accommodated in the heat storage capsule 8. Accordingly, since heat radiation from the engine 2 to the outside air can be reduced, the temperature of the cooling water flowing through the cooling circuit 3 can be promptly raised, and high temperature cooling water can be secured in the heat accumulator 51 in an early stage. In addition, the thermal management system 1A is different from the thermal management system 1 according to the first embodiment in that the amount of the traveling wind introduced into the heat storage capsule 8 from the outside air inlet 81 formed in the heat storage capsule 8 is adjusted by the outside air shutter 9. Accordingly, according to the thermal management system 1A, the same effects as those in the above (1) to (7) are achieved.

The above has explained embodiments of the disclosure, but the disclosure is not limited thereto. Details of the construction may be properly changed within the scope of spirit of the disclosure.

What is claimed is:

1. A thermal management system of a vehicle, the thermal management system comprising:

a cooling circuit in which cooling water exchanging heat with an engine circulates;

a heat accumulator connected to the cooling circuit and storing the cooling water;

a first valve adjusting a flow rate of the cooling water flowing from the cooling circuit to the heat accumulator;

a radiator connected to the cooling circuit and performing heat exchange between the cooling water and the atmosphere;

a second valve adjusting the flow rate of the cooling water flowing from the cooling circuit to the radiator;

a shutter adjusting amount of outside air introduced from a front grille into an engine room;

a cooling water temperature acquisition unit acquiring a cooling water temperature of the cooling circuit;

a heat radiation control unit supplying the cooling water from the heat accumulator to the cooling circuit to warm up the engine when the engine is cold; and a heat storage control unit executing heat storage control in which, by controlling an opening degree of the first valve and an opening degree of the shutter according to the cooling water temperature, the cooling water whose temperature is raised by heat of the engine is supplied from the cooling circuit to the heat accumulator.

2. A thermal management system of a vehicle, the thermal management system comprising:

a cooling circuit in which cooling water exchanging heat with an engine circulates;

a heat accumulator connected to the cooling circuit and storing the cooling water;

a first valve adjusting a flow rate of the cooling water flowing from the cooling circuit to the heat accumulator;

a radiator connected to the cooling circuit and performing heat exchange between the cooling water and the atmosphere;

a second valve adjusting the flow rate of the cooling water flowing from the cooling circuit to the radiator;

an insulating container accommodating at least the engine;

a shutter adjusting amount of outside air introduced into the insulating container from an outside air inlet formed in the insulating container;

a cooling water temperature acquisition unit acquiring a cooling water temperature of the cooling circuit;

a heat radiation control unit supplying the cooling water from the heat accumulator to the cooling circuit to warm up the engine when the engine is cold; and a heat storage control unit executing heat storage control in which, by controlling an opening degree of the first valve and an opening degree of the shutter according to the cooling water temperature, the cooling water whose temperature is raised by heat of the engine is supplied from the cooling circuit to the heat accumulator.

3. The thermal management system of a vehicle according to claim 1, wherein, during execution of the heat storage control, when the cooling water temperature is lower than a valve opening temperature of the second valve, the heat storage control unit controls the shutter to be in a closed state, and after the cooling water temperature becomes higher than the valve opening temperature, the heat storage control unit controls the shutter to be in an opened state.

4. The thermal management system of a vehicle according to claim 1, further comprising a heat accumulator water temperature acquisition unit acquiring a heat accumulator outlet water temperature being a temperature of the cooling water flowing out from the heat accumulator, wherein after starting the heat storage control on condition that the cooling water temperature is equal to or higher than the valve opening temperature of the second valve, the heat storage control unit terminates the heat storage control according to the fact that the heat accumulator outlet water temperature exceeds an end temperature determined according to the cooling water temperature, wherein the end temperature is determined lower than the cooling water temperature by a predetermined temperature, wherein the predetermined temperature is predetermined by considering influence of a temperature drop due to heat radiation of the cooling water flowing through a passage connecting the cooling circuit with the heat accumulator.

5. The thermal management system of a vehicle according to claim 4, wherein the heat storage control unit sets a target opening degree of the first valve toward a closing side as a temperature difference obtained by subtracting the heat accumulator outlet water temperature from the cooling water temperature increases, and controls the opening degree of the first valve to be the target opening degree.

6. The thermal management system of a vehicle according to claim 1, wherein when the cooling water temperature is in the process of rising, the heat storage control unit executes the heat storage control, and when the cooling water temperature is in the process of falling, the heat storage control unit does not execute the heat storage control.

7. The thermal management system of a vehicle according to claim 1, wherein the shutter is controlled to be in the opened state when the cooling water temperature is higher than a predetermined shutter opening temperature, and the heat storage control unit raises the shutter opening temperature in a case where the heat storage control is being executed as compared with a case where the heat storage control is not being executed.

8. The thermal management system of a vehicle according to claim 1, wherein the heat storage control unit stores, as an end time water temperature, the temperature of the cooling water inside the heat accumulator or flowing out from the heat accumulator at termination of the heat storage control, and, if the cooling water temperature becomes higher than the end time water temperature after termination of the heat storage control, executes the heat storage control again.

9. The thermal management system of a vehicle according to claim 2, wherein, during execution of the heat storage control, when the cooling water temperature is lower than a valve opening temperature of the second valve, the heat storage control unit controls the shutter to be in a closed state, and after the cooling water temperature becomes higher than the valve opening temperature, the heat storage control unit controls the shutter to be in an opened state.

10. The thermal management system of a vehicle according to claim 2, further comprising a heat accumulator water temperature acquisition unit acquiring a heat accumulator outlet water temperature being a temperature of the cooling water flowing out from the heat accumulator, wherein after starting the heat storage control on condition that the cooling water temperature is equal to or higher than the valve opening temperature of the second valve, the heat storage control unit terminates the heat storage control according to the fact that the heat accumulator outlet water temperature exceeds an end temperature determined according to the cooling water temperature, wherein the end temperature is determined lower than the cooling water temperature by a predetermined temperature, wherein the predetermined temperature is predetermined by considering influence of a temperature drop due to heat radiation of the cooling water flowing through a passage connecting the cooling circuit with the heat accumulator.

11. The thermal management system of a vehicle according to claim 3, further comprising a heat accumulator water temperature acquisition unit acquiring a heat accumulator outlet water temperature being a temperature of the cooling water flowing out from the heat accumulator, wherein after starting the heat storage control on condition that the cooling water temperature is equal to or higher than the valve opening temperature of the second valve, the heat storage control unit terminates the heat storage control according to the fact that the heat accumulator outlet water temperature exceeds an end temperature determined according to the cooling water temperature, wherein the end temperature is determined lower than the cooling water temperature by a predetermined temperature, wherein the predetermined temperature is predetermined by considering influence of a temperature drop due to heat radiation of the cooling water flowing through a passage connecting the cooling circuit with the heat accumulator.

12. The thermal management system of a vehicle according to claim 2, wherein when the cooling water temperature is in the process of rising, the heat storage control unit executes the heat storage control, and when the cooling water temperature is in the process of falling, the heat storage control unit does not execute the heat storage control.

13. The thermal management system of a vehicle according to claim 3, wherein when the cooling water temperature is in the process of rising, the heat storage control unit executes the heat storage control, and when the cooling water temperature is in the process of falling, the heat storage control unit does not execute the heat storage control.

14. The thermal management system of a vehicle according to claim 4, wherein when the cooling water temperature is in the process of rising, the heat storage control unit executes the heat storage control, and when the cooling water temperature is in the process of falling, the heat storage control unit does not execute the heat storage control.

15. The thermal management system of a vehicle according to claim 5, wherein when the cooling water temperature is in the process of rising, the heat storage control unit executes the heat storage control, and when the cooling water temperature is in the process of falling, the heat storage control unit does not execute the heat storage control.

16. The thermal management system of a vehicle according to claim 2, wherein the shutter is controlled to be in the opened state when the cooling water temperature is higher than a predetermined shutter opening temperature, and the heat storage control unit raises the shutter opening temperature in a case where the heat storage control is being executed as compared with a case where the heat storage control is not being executed.

17. The thermal management system of a vehicle according to claim 3, wherein the shutter is controlled to be in the opened state when the cooling water temperature is higher than a predetermined shutter opening temperature, and the heat storage control unit raises the shutter opening temperature in a case where the heat storage control is being executed as compared with a case where the heat storage control is not being executed.

18. The thermal management system of a vehicle according to claim 4, wherein the shutter is controlled to be in the opened state when the cooling water temperature is higher than a predetermined shutter opening temperature, and the heat storage control unit raises the shutter opening temperature in a case where the heat storage control is being executed as compared with a case where the heat storage control is not being executed.

19. The thermal management system of a vehicle according to claim 5, wherein the shutter is controlled to be in the opened state when the cooling water temperature is higher than a predetermined shutter opening temperature, and the heat storage control unit raises the shutter opening temperature in a case where the heat storage control is being executed as compared with a case where the heat storage control is not being executed.

20. The thermal management system of a vehicle according to claim 6, wherein the shutter is controlled to be in the opened state when the cooling water temperature is higher than a predetermined shutter opening temperature, and the heat storage control unit raises the shutter opening temperature in a case where the heat storage control is being executed as compared with a case where the heat storage control is not being executed.

* * * * *